US008544429B2

(12) United States Patent
Nakamura et al.

(10) Patent No.: US 8,544,429 B2
(45) Date of Patent: Oct. 1, 2013

(54) VALVE CONTROL APPARATUS FOR INTERNAL COMBUSTION ENGINE

(75) Inventors: Makoto Nakamura, Zushi (JP); Seiji Tsuruta, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 393 days.

(21) Appl. No.: 12/944,301

(22) Filed: Nov. 11, 2010

(65) Prior Publication Data

US 2011/0120398 A1 May 26, 2011

(30) Foreign Application Priority Data

Nov. 26, 2009 (JP) ..... 2009-268199

(51) Int. Cl.
*F01L 1/34* (2006.01)

(52) U.S. Cl.
USPC ..... 123/90.16; 123/90.39

(58) Field of Classification Search
USPC ..... 123/90.16, 90.17, 90.39
See application file for complete search history.

(56) References Cited

U.S. PATENT DOCUMENTS

2009/0188454 A1 7/2009 Nakamura et al.

FOREIGN PATENT DOCUMENTS

| | | | |
|---|---|---|---|
| JP | 60-69222 | A | 4/1985 |
| JP | 61-101605 | U | 6/1986 |
| JP | 2009-103040 | A | 5/2009 |
| JP | 2009-180114 | A | 8/2009 |

OTHER PUBLICATIONS

Japanese Office Action dated Nov. 6, 2012 (two (2) pages).
Japanese Office Action dated Feb. 7, 2012 (three (3) pages).

*Primary Examiner* — Zelalem Eshete
(74) *Attorney, Agent, or Firm* — Crowell & Moring LLP

(57) ABSTRACT

A valve control apparatus includes a variable mechanism configured to vary operating states of two intake valves by varying a swing range of a single swing cam; a primary swing arm configured to receive swinging force from the swing cam by becoming in contact with the swing cam, and configured to open/close one of the two intake valves; a secondary swing arm configured to open/close another of the two intake valves; and a connection changeover mechanism configured to connect/disconnect the primary swing arm with/from the secondary swing arm in accordance with an operating state of engine. The connection changeover mechanism disconnects the primary swing arm from the secondary swing arm to maintain the another of the two intake valves in a non-lifted state, when the variable mechanism controls a swing amount of the primary swing arm within a range below a predetermined amount. The connection changeover mechanism connects the primary swing arm with the secondary swing arm to open and close both of the two intake valves together, when the variable mechanism controls the swing amount of the primary swing arm within a range greater than or equal to the predetermined amount.

18 Claims, 16 Drawing Sheets

P
27
24a
θ1
28a
α
29
15a
15b
R
28
28b
Q1
15d
15e
15
15c
21
S
17a
19
17
18
7c
T
17b
30a
42
32
37b
34a
34
30
30b
33a
3a
10a
7
7b
4
7d
Y
5a
16a
16c
16
X
35
35a
31
31a
37a
31b
33b
3b
10b

P
27
24a
28a
29
α
15a
15b
R
28
28b
Q1
15d
15
15c
15e
21
S
17a
19
17
18
7c
T
17b
7d
7
Y
4
7b
30
34
34a
37b
32
42
30a
30b
33a
3a
10a
16
5a
16a
16c
β1
α1
X
γ1
35
35a
31
31a
37a
31b
33b
3b
10b

P
27
24a
28a
α
29
15a
15b
R
θ2
28
28b
Q2
15d
15
15e
15c
21
S
17a
19
17
18
7c
T
17b
7
7b
4
7d
Y
34
30
30b
33a
3a
10a
34a
37b
32
42
30a
16
5a
16a
16c
X
35
35a
31
31b
33b
3b
10b
37a
31a

P
27
24a
28a
28
28b
α
15
15a
15b
15c
15d
15e
21
29
Q2
R
S
17
17a
17b
18
19
7
7b
7c
7d
T
Y
4
γ2
β2
α2
X
5a
16
16a
16c
30
30a
30b
32
33a
33b
3a
3b
10a
10b
34
34a
37a
37b
42
31
31a
31b
35
35a 27
24a
28
28b
α
15d
29
15a
15b
R
Q3
P
28a
15
15c
21
17a
S
19
15e
17
18
7c
T
17b
7
Y
4
7b
7d
30a
42
32
38
37b
34a
34
30
30b
33a
3a
10a
16
5a
16a
16c
β3
α3
X
γ3
15e R
35
35a
31
31a
31b
33b
3b
10b
37a

VALVE CONTROL APPARATUS FOR INTERNAL COMBUSTION ENGINE

BACKGROUND OF THE INVENTION

The present invention relates to a valve control apparatus for an internal combustion engine, which is able to vary a lift-amount characteristic or the like of an intake valve and/or an exhaust valve in accordance with an operating state of engine.

Japanese Patent Application Publication No. 2009-103040 discloses a previously-proposed valve control apparatus in the field. This valve control apparatus includes a holder which swings by being driven by a control cam, a sub-cam which is driven by an intake cam, first and second rocker arms which open and close first and second intake valves by being driven by the sub-cam, and a connection changeover mechanism which connects the first rocker arm with the second rocker arm or disconnects the first rocker arm from the second rocker arm.

The sub-cam includes a drive cam surface and a rest cam surface given for a minute lift. A lift-amount characteristic of each of the first and second intake valves can be continuously varied according to a swing position of the holder.

In a high-load region of engine, the connection changeover mechanism connects the first rocker arm with the second rocker arm so that the first and second intake valves are driven (opened and closed) by the drive cam surface of sub-cam. Thereby, an intake-air charging efficiency is enhanced to increase an output torque of engine.

On the other hand, in a low-load region of engine, the connection changeover mechanism disconnects the first rocker arm from the second rocker arm. Thereby, the first intake valve is driven by the drive cam surface of sub-cam, and the second intake valve is made substantially in a closed state (minute-lift state) by the rest cam surface. Because of this lift difference between the first and second intake valves, an intake-air swirl effect is produced in a cylinder, so that a combustion of the engine is improved. Hence, a fuel economy is improved.

SUMMARY OF THE INVENTION

However, in the above-mentioned previous valve control apparatus, the second intake valve becomes in the pseudo closed state (i.e., minute-lift state) which is attained by the rest cam surface, in the low-load region of engine. Hence, there is a risk that the second intake valve cannot be maintained in a certainly closed state (i.e., non-lifted state or zero-lift state). As a countermeasure, in order to obtain a sufficient lift difference between the first and second intake valves, the lift-amount characteristic (or working-angle characteristic) of the first intake valve needs to be increased by that much. However, as a result of this, there is a risk that a friction and a pumping loss are increased.

Moreover, because slight air flows into the cylinder also from the second intake valve in the low-load region, the intake-air swirl effect cannot be sufficiently obtained, and the fuel economy cannot be sufficiently improved.

It is therefore an object of the present invention to provide a valve control apparatus devised to solve or ease the above-mentioned problem.

According to one aspect of the present invention, there is provided a valve control apparatus for an internal combustion engine, comprising: a variable mechanism configured to vary operating states of two intake valves by varying a swing range of a single swing cam, the single swing cam being swingably supported by a shaft, the two intake valves being provided to one cylinder; a primary swing arm configured to receive a swinging force from the swing cam by becoming in contact with the swing cam, and to open and close one of the two intake valves, within a contact range between the swing cam and the primary swing arm relative to an axial direction of the shaft; a secondary swing arm configured to open and close another of the two intake valves by a swing motion of the secondary swing arm; and a connection changeover mechanism configured to connect the primary swing arm with the secondary swing arm or disconnect the primary swing arm from the secondary swing arm in accordance with an operating state of the engine, wherein the connection changeover mechanism is configured to disconnect the primary swing arm from the secondary swing arm to maintain the another of the two intake valves in a non-lifted state, when the variable mechanism controls a swing amount of the primary swing arm within a range below a predetermined amount, and wherein the connection changeover mechanism is configured to connect the primary swing arm with the secondary swing arm to open and close both of the two intake valves together, when the variable mechanism controls the swing amount of the primary swing arm within a range greater than or equal to the predetermined amount.

According to another aspect of the present invention, there is provided a valve control apparatus for an internal combustion engine, comprising: a variable mechanism including a drive cam configured to rotate in synchronization with a crankshaft, a single swing cam swingably supported by a support shaft, and configured to vary operating states of a pair of intake valves by a variation of swing range of the swing cam, a transmission mechanism configured to convert a rotational motion of the drive cam to a swing motion, and to transmit a force of the swing motion to the swing cam, and a control mechanism configured to vary an attitude of the transmission mechanism and thereby to vary the swing range of the swing cam; a primary swing arm configured to receive a swinging force from the swing cam by becoming in contact with the swing cam, and configured to open and close one of the intake valves within a width range of the swing cam; a secondary swing arm configured to drive another of the intake valves by a swing motion of the secondary swing arm; and a connection changeover mechanism configured to connect the primary swing arm with the secondary swing arm or disconnect the primary swing arm from the secondary swing arm in accordance with an operating state of the engine, wherein lift characteristics of the pair of intake valves become substantially equal to each other when the connection changeover mechanism has connected the primary swing arm with the secondary swing arm, wherein the another of the intake valves is maintained in a non-lifted state when the connection changeover mechanism has disconnected the primary swing arm from the secondary swing arm.

According to still another aspect of the present invention, there is provided a valve control apparatus for an internal combustion engine, comprising: a variable mechanism configured to vary operating states of two intake valves by varying a swing range of a single swing cam at least in accordance with an engine load, the two intake valves being provided to one cylinder of the engine; a primary swing arm configured to receive a swinging force from the swing cam by allowing a roller of the primary arm to become in contact with the swing cam, and to open and close one of the two intake valves, within a width range of the roller relative to an axial direction of the roller; a secondary swing arm configured to open and close another of the two intake valves by a swing motion of the secondary swing arm; and a connection changeover mechanism configured to connect the primary swing arm with the secondary swing arm or disconnect the primary swing arm from the secondary swing arm in accordance with an operating state of the engine, wherein the connection changeover mechanism is configured to disconnect the primary swing arm from the secondary swing arm to maintain the another of the two intake valves in a non-lifted state, when the engine load is lower than a predetermined level, and wherein the connection changeover mechanism is configured to connect the primary swing arm with the secondary swing arm to cause lift characteristics of the two intake valves to become substantially equal to each other, when the engine road is greater than or equal to the predetermined level.

The other objects and features of this invention will become understood from the following description with reference to the accompanying drawings.

BRIEF DESCRIPTION OF DRAWINGS

FIG. 4A is a cross sectional view of FIG. 2 which is taken along a line A-A, under a closed state of first intake valve. FIG. 4B is a cross sectional view of FIG. 2 which is taken along a line B-B, under the closed state of first intake valve. FIG. 4C is a cross sectional view of FIG. 2 which is taken along a line C-C, under the closed state of first intake valve (and also under a closed state of second intake valve).

FIG. 5A is a cross sectional view of FIG. 2 which is taken along the line A-A, at the time of peak lift under an open state of the first intake valve. FIG. 5B is a cross sectional view of FIG. 2 which is taken along the line B-B, at the time of peak lift under the open state of first intake valve. FIG. 5C is a cross sectional view of FIG. 2 which is taken along the line C-C, and shows a state where the second intake valve has been closed at the time of peak lift under the open state of first intake valve.

FIG. 6A is a cross sectional view of FIG. 2 which is taken along the line A-A, under the closed state of first intake valve. FIG. 6B is a cross sectional view of FIG. 2 which is taken along the line B-B, under the closed state of first intake valve. FIG. 6C is a cross sectional view of FIG. 2 which is taken along the line C-C, under the closed state of first intake valve (and also under the closed state of second intake valve).

FIG. 7A is a cross sectional view of FIG. 2 which is taken along the line A-A, at the time of peak lift under the open state of first intake valve. FIG. 7B is a cross sectional view of FIG. 2 which is taken along the line B-B, at the time of peak lift under the open state of first intake valve. FIG. 7C is a cross sectional view of FIG. 2 which is taken along the line C-C, and shows a state where the second intake valve has been closed at the time of peak lift under the open state of first intake valve.

FIG. 8A is a cross sectional view of FIG. 2 which is taken along the line A-A, under the closed state of first intake valve. FIG. 8B is a cross sectional view of FIG. 2 which is taken along the line B-B, under the closed state of first intake valve. FIG. 8C is a cross sectional view of FIG. 2 which is taken along the line C-C, under the closed state of first intake valve (and also under the closed state of second intake valve).

FIG. 9A is a cross sectional view of FIG. 2 which is taken along the line A-A, at the time of peak lift under the open state of first intake valve. FIG. 9B is a cross sectional view of FIG. 2 which is taken along the line B-B, at the time of peak lift under the open state of first intake valve. FIG. 9C is a cross sectional view of FIG. 2 which is taken along the line C-C, and shows a state where the second intake valve has been opened at the time of peak lift under the open state of first intake valve.

DETAILED DESCRIPTION OF THE INVENTION

Figure 1:
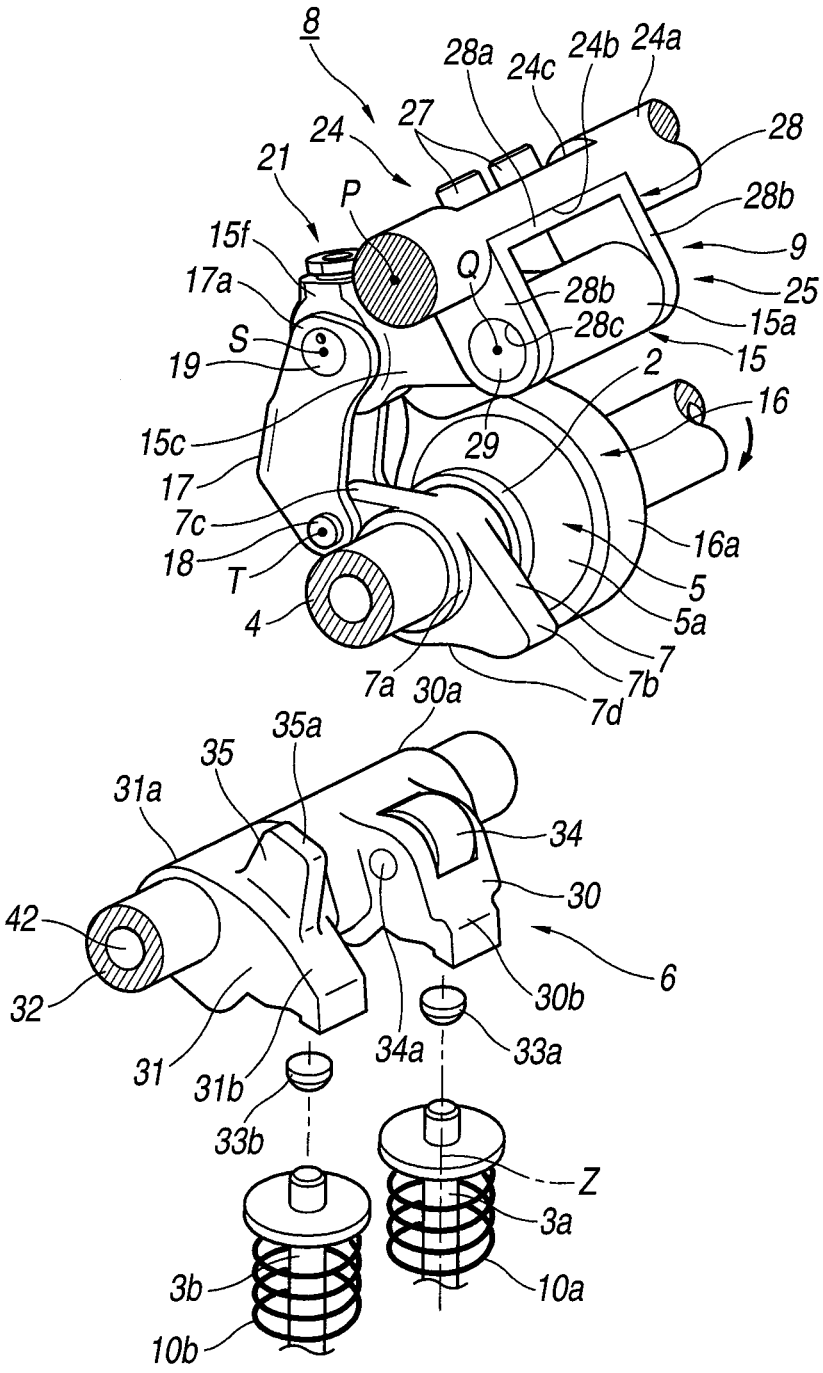
FIG. 1 is a schematic oblique perspective view of main parts of a valve control apparatus in a first embodiment according to the present invention.

Hereinafter, embodiments of valve control apparatus for internal combustion engine according to the present invention will be described referring to the drawings. In the respective embodiments, the valve control apparatus is applied to an intake side of multi-cylinder internal combustion engine. This engine is constructed to cause its fuel injection valves to inject fuel directly into cylinders of the engine.

[First Embodiment]

Figure 2:
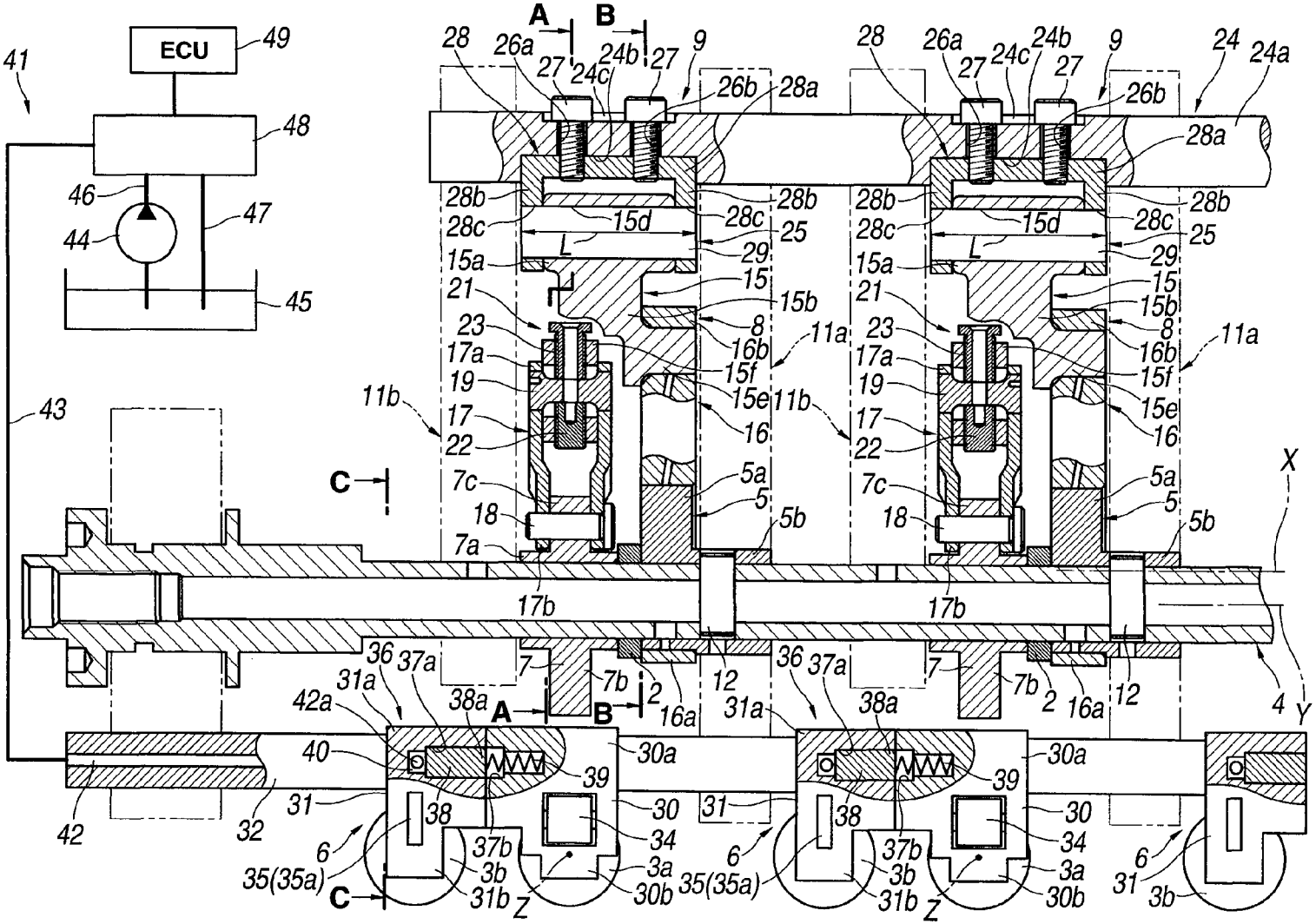
FIG. 2 is a cross sectional view of the main parts of valve control apparatus in the first embodiment.

As shown in FIGS. 1 and 2, a valve control apparatus in a first embodiment according to the present invention includes first and second intake valves 3*a* and 3*b*; a drive shaft 4; a swing mechanism 6; a single swing cam 7; a drive cam 5; a transmission mechanism 8; and a control mechanism 9. Each of the first and second intake valves 3*a* and 3*b* is provided slidably in a cylinder head 1 through a valve guide, and opens and closes an intake port. Each cylinder of the plurality of cylinders is equipped with the first and second intake valves 3*a* and 3*b*, i.e., two intake valves. The drive shaft 4 is disposed in a front-rear direction of the engine, and is formed in an internally hollow shape. The swing mechanism 6 is provided on upper end portions of the respective intake valves 3*a* and 3*b*. The single swing cam 7 operates opening/closing movements of the respective intake valves 3*a* and 3*b* through the swing mechanism 6. The after-explained drive cam 5 is provided on an outer circumference of the drive shaft 4. The transmission mechanism 8 links or coordinates the drive cam 5 with the swing cam 7. The transmission mechanism 8 converts a rotational force of the drive cam 5 to a swinging motion, and transmits this swinging motion to the swing cam 7 as a swinging force. Thus, the control mechanism 9 controls the intake valves 3*a* and 3*b* so as to continuously vary a valve lift-amount characteristic of each intake valve 3*a*, 3*b* and a valve working angle (valve-open-period angle range) of each intake valve 3*a*, 3*b* in accordance with an operating state of the engine, by varying an attitude (position) of the transmission mechanism 8 and thereby varying a swing range of the swing cam 7.

In this embodiment, the valve working angle means a time interval for which each intake valve 3*a*, 3*b* is open. Moreover, the swing cam 7 cooperates with the transmission mechanism 8 and the control mechanism 9 to define a variable mechanism. This variable mechanism is provided to every cylinder. That is, each cylinder has one variable mechanism which is constituted by the swing cam 7, the transmission mechanism 8 and the control mechanism 9.

The first intake valve 3*a* is biased (urged) by a valve spring 10*a* in a direction that closes (blocks) an open end of the intake port. The valve spring 10*a* is resiliently attached between a bottom portion of an approximately-cylindrically-shaped bore formed in an upper end portion of the cylinder head 1 and a spring retainer provided to an upper end portion of valve stem. In the same manner, the second intake valve 3*b* is biased by a valve spring 10*b* in a direction that closes or blocks an open end of the intake port. The valve spring 10*b* is resiliently attached between a bottom portion of an approximately-cylindrically-shaped bore formed in the upper end portion of cylinder head 1 and a spring retainer provided to an upper end portion of valve stem.

The drive shaft 4 is formed in a hollow shape, i.e., is formed with an oil passage provided axially inside the drive shaft 4. The drive cam 5 is fixed to the outer circumference of the drive shaft 4. Both end portions of the drive shaft 4 are provided in an upper portion of the cylinder head 1. The drive shaft 4 is rotatably supported by first and second bearing portions 11*a* and 11*b* provided on both lateral portions of the variable mechanism. Each cylinder includes one pair of first and second bearing portions 11*a* and 11*b*. Moreover, a timing chain (not shown) is provided on one end portion of drive shaft 4, and thereby, rotational force is transmitted from a crankshaft of the engine through the timing chain to the drive shaft 4. Thus, the drive shaft 4 is able to rotate in a clockwise direction (arrow direction) of FIG. 1.

The drive cam 5 includes a cam main body 5*a* and a boss portion 5*b*. The cam main body 5*a* is formed approximately in a disc shape. As shown in FIG. 2, the boss portion 5*b* is formed in a tubular shape, and is provided integrally with an (axially) outside portion of the cam main body 5*a*. The drive cam 5 is fixed to the drive shaft 4 by a fixing pin 12. The fixing pin 12 passes through a pin hole which was drilled in the boss portion 5*b* in a radial direction. Moreover, the drive cam 5 is disposed on one end side of the swing cam 7 relative to an axial direction of drive shaft 4. The boss portion 5*b* is located on an opposite side of the cam main body 5*a* from the swing cam 7. An outer circumferential surface of the cam main body 5*a* is formed in a cam profile of eccentric circle. That is, a shaft center X (i.e., a center of the outer circumferential surface) of the cam main body 5*a* is offset (deviated) from a shaft center Y of the drive shaft 4 in the radial direction by a predetermined amount.

As shown in FIG. 1, the swing mechanism 6 is constituted by two of a primary swing arm 30 and a secondary swing arm 31. The secondary swing arm 31 is provided adjacent to a lateral portion of the primary swing arm 30 relative to the axial direction. The both swing arms 30 and 31 are provided independently from each other (i.e., provided as components that can move independently from each other). The primary swing arm 30 includes a base end portion 30*a* and a tip portion 30*b*, and the secondary swing arm 31 includes a base end portion 31*a* and a tip portion 31*b*. The base end portions 30*a* and 31*a* are swingably supported by one rocker shaft 32. The tip portions 30*b* and 31*b* protrude in the same direction respectively from the base end portions 30*a* and 31*a*. A lower surface of the tip portion 30*b* is formed with a circular concave portion. Similarly, a lower surface of the tip portion 31*b* is formed with a circular concave portion. The tip portion 30*b* is in contact with the upper surface of a stem end of first intake valve 3*a* through a disc-shaped shim 33*a* fitted into the concave portion of tip portion 30*b*. Similarly, the tip portion 31*b* is in contact with the upper surface of a stem end of second intake valve 3*b* through a disc-shaped shim 33*b* fitted into the concave portion of tip portion 31*b*.

Figures 4A, 4B, 4C:
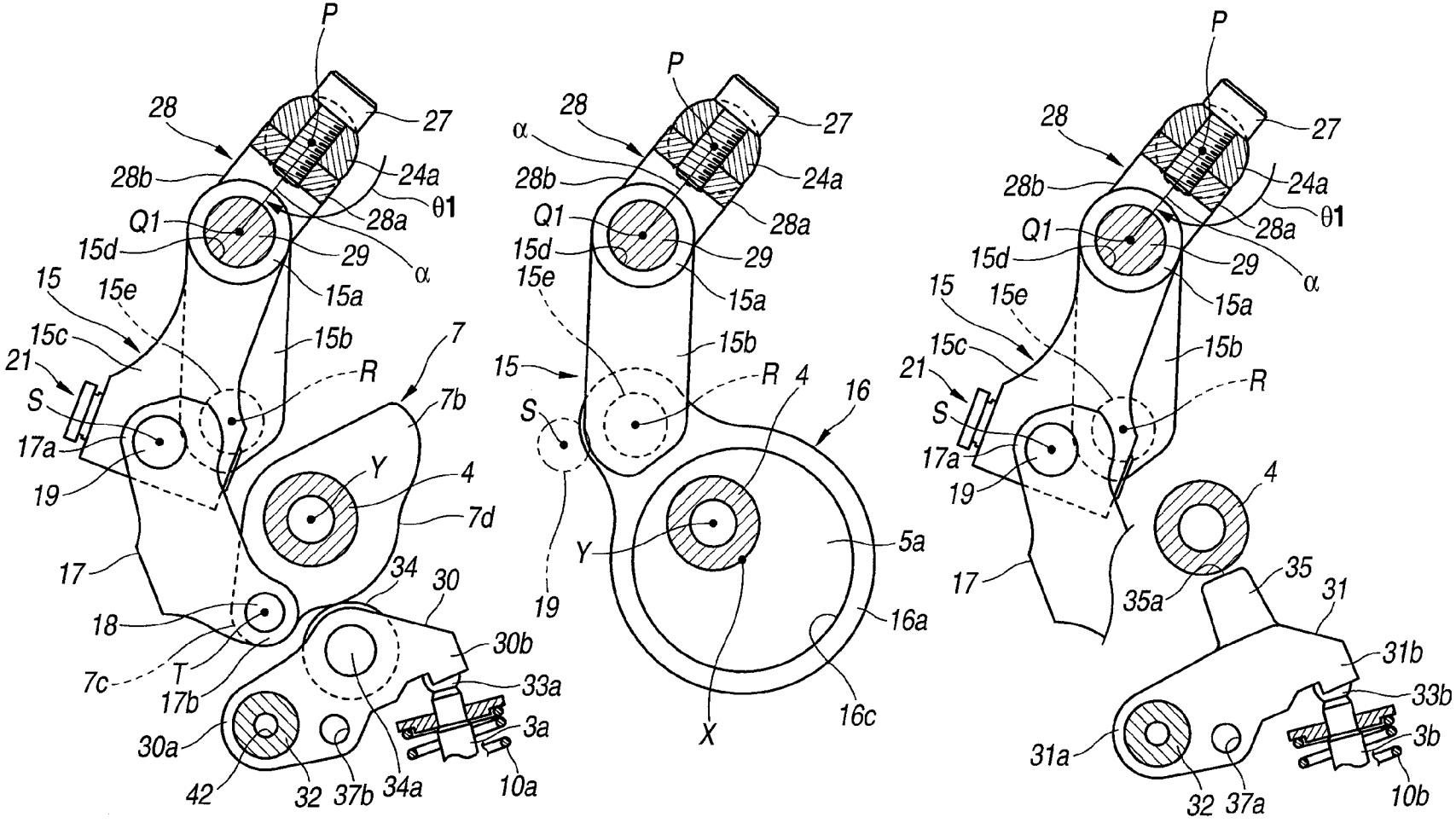
FIGS. 4A to 4C are cross sectional views under a minimum working angle.

The primary swing arm 30 is provided at a location identical with a location of the swing cam 7 relative to a width direction of the engine (right-left direction of FIG. 4A). A roller 34 is provided to an approximately center portion of width range of the primary swing arm 30 in the axial direction of rocker shaft 32. The roller 34 rotatably abuts on an after-mentioned cam surface of the swing cam 7. An approximately center portion of this roller 34 in a width direction of roller 34 accords with the location of an axis (stem center) Z of the valve stem of first intake valve 3*a*. The roller 34 is rotatably received by a concave groove of the primary swing arm 30 through a roller pin 34*a*. This concave groove is formed at an approximately center portion of the primary swing arm 30. An upper end portion of the roller 34 is constantly exposed to the side of swing cam 7.

The secondary swing arm 31 is provided to be offset from (away from) the swing cam 7 in the axial direction. Hence, the swinging force of swing cam 7 is not directly transmitted to the secondary swing arm 31. A spherical lower surface of the shim 33*b* of tip portion 31*b* is in contact with the upper surface of stem end of second intake valve 3*b*. When an after-mentioned connection changeover mechanism 36 connects (interlocks) the secondary swing arm 31 with the primary swing arm 30, the secondary swing arm 31 opens the second intake valve 3*b* by pressing against a spring force of the valve spring 10*b*.

The secondary swing arm 31 includes a stopper convex portion 35 at an approximately center portion of secondary swing arm 31 relative to a width direction of secondary swing arm 31. The stopper convex portion 35 is provided integrally with the secondary swing arm 31 to protrude from an upper surface of the secondary swing arm 31. The stopper convex portion 35 restricts an upward movement (swing motion) of the secondary swing arm 31 by allowing an upper surface 35*a* of the stopper convex portion 35 to abut on an outer circumferential surface of drive shaft 4, in a case that the secondary swing arm 31 has moved upwardly when the second intake valve 3*b* is closed. That is, the stopper convex portion 35 becomes in contact with the support shaft 4 to prevent the secondary swing arm 31 from swinging toward the drive shaft 4 beyond a predetermined location.

The respective lower surfaces of shims 33*a* and 33*b* which are in contact with the first and second intake valves 3*a* and 3*b* are formed in an approximately spherical shape. Thereby, wherever each swing arm 30, 31 is located in its swing range, the shim 33*a*, 33*b* can press a portion near the center (line Z of FIGS. 1 and 2) of stem end of intake valve 3*a*, 3*b*. Moreover, a thickness of the shim 33*a* is appropriately selected by selecting from multiple shims having different thickness values, so that a space between the stem end of first intake valve 3*a* and the shim 33*a* is adjusted to become a slight clearance near zero especially when the first intake valve 3*a* is in a non-lifted state (closed state). Similarly, the shim 33*b* is appropriately selected among multiple shims having different thickness values, so that the a space between the stem end of second intake valve 3*b* and the shim 33*b* is adjusted to become a slight clearance near zero when the second intake valve 3*b* is in the non-lifted state under a state where the both swing arms 30 and 31 have been connected (interlocked) with each other by the after-mentioned connection changeover mechanism 36.

As shown in FIG. 2, the connection changeover mechanism 36 includes a first retaining hole 37*a*, a second retaining hole 37*b*, a plunger 38, a coil spring 39, a pressure-receiving chamber 40, and a hydraulic circuit 41. The secondary swing arm 31 is formed with the first retaining hole 37*a*, and the primary swing arm 30 is formed with the second retaining hole 37*b*. The first retaining hole 37*a* and the second retaining hole 37*b* are formed continuously inside the both base end portions 30*a* and 31*a* of swing arms 30 and 31 in the axial direction. The plunger 38 is provided for the interlock between the primary and secondary swing arms 30 and 31, and is retained in the first retaining hole 37*a*. A front-end portion 38*a* of the plunger 38 can slide into the second retaining hole 37*b* so as to engage the primary swing arm 30 with the secondary swing arm 31. The coil spring 39 is elastically retained in the second retaining hole 37*b*, i.e., is a biasing member for biasing the plunger 38 toward the first retaining hole 37*a*. The pressure-receiving chamber 40 is formed on a rear-end side of the first retaining hole 37*a*. The pressure-receiving chamber 40 can apply oil pressure to the plunger 38 to appropriately move the plunger 38 toward the second retaining hole 37*b* against the biasing force of coil spring 39. The hydraulic circuit 41 supplies/discharges oil pressure to/from the pressure-receiving chamber 40.

The hydraulic circuit 41 includes a hydraulic-pressure supply/discharge passage 43, an oil pump 44, an electromagnetic changeover valve 48, and an electronic controller (ECU) 49. As shown in FIG. 2, the hydraulic-pressure supply/discharge passage 43 supplies and discharges working oil pressure to/from the pressure-receiving chamber 40 through an oil hole 42*a* and an oil passage 42. The oil passage 42 is formed axially inside the rocker shaft 32. The oil pump 44 pumps working oil stored in an oil pan 45, through a supply passage 46 to the hydraulic-pressure supply/discharge passage 43. The electromagnetic changeover valve 48 switches between the supply passage 46 and a drain passage 47 in order to communicate one of the supply passage 46 and the drain passage 47 with the hydraulic-pressure supply/discharge passage 43. The electronic controller 49 controls the switching operation of electromagnetic changeover valve 4.

The electronic controller 49 receives information signals derived from various kinds of sensors such as a crank angle sensor, an air flow meter and an engine water-temperature sensor (not shown). Thus, the electronic controller 49 detects a current operating state of the engine, and thereby, outputs control signals to the electromagnetic changeover valve 48.

As shown in FIGS. 1 and 4A, the swing cam 7 is formed approximately in a raindrop shape. The swing cam 7 is formed integrally with a cam shaft 7*a* provided on a side of base end portion of swing cam 7. The cam shaft 7*a* is formed in a short circular-tube shape, and is fitted over the outer circumferential surface of drive shaft 4 by insertion. The swing cam 7 is supported to be able to swing about the shaft center Y of drive shaft 4 via the cam shaft 7*a*. That is, the shaft center Y serves as a swing axis of the swing cam 7.

The swing cam 7 includes a cam nose portion 7*b* in a tip side of the swing cam 7. As shown in FIG. 4A, a lower surface of the swing cam 7 includes a cam surface 7*d* formed between the base end portion of swing cam 7 and the cam nose portion 7*b*. This cam surface 7*d* includes a base circular surface, a ramp surface and a lift surface. The base circular surface is located at a side of the base end portion. The ramp surface extends in a circular-arc shape (in cross section) from the base circular surface toward the cam nose portion 7*b*. The lift surface extends from the ramp surface to a maximum-lift top surface of the cam surface 7*d*. This maximum-lift top surface is located in a tip side of the cam nose portion 7*b*. The cam surface 7*d* is constantly in contact with the outer circumferential surface of roller 34 of primary swing arm 30. The swing cam 7 varies the lift amount of intake valve 3*a*, 3*b*, by varying a contact point between the cam surface 7*d* and the roller 34 in accordance with a swing position of the swing cam 7.

A swinging direction of swing cam 7 when opening the first intake valve 3*a* (i.e., when the contact point between the cam surface 7*d* and the roller 34 moves toward the lift surface) is identical with a rotational direction of the drive shaft 4 (arrow direction in FIG. 1). Accordingly, a drag torque is applied to the swing cam 7 in the direction that lifts the first intake valve 3*a*, because of a friction coefficient between the drive shaft 4 and the swing cam 7. Therefore, a drive efficiency of the swing cam 7 is improved.

Moreover, the swing cam 7 includes a connecting portion 7*c* located on an opposite side of the cam shaft 7*a* from the cam nose portion 7*b*. That is, the cam shaft 7*a* is located between the cam nose portion 7*b* and the connecting portion 7*c*, and this connecting portion 7*c* is formed integrally with the swing cam 7 to protrude from the swing cam 7. The connecting portion 7*c* is formed with a pin hole passing through both lateral surfaces of the connecting portion 7*c*, i.e., passing through the swing cam 7 in the axial direction of drive shaft 4. A connecting pin 18 for connecting the swing cam 7 with an after-mentioned another end portion 17*b* of link rod 17 is inserted into the pin hole.

As shown in FIGS. 1 to 4C, the transmission mechanism 8 includes a rocker arm 15, a link arm 16 and the link rod 17. The rocker arm 15 is disposed (to extend) along the width direction of engine above the drive shaft 4. The link arm 16 links the rocker arm 15 with the drive cam 5. The link rod 17 links the rocker arm 15 with the connecting portion 7*c* of swing cam 7. That is, the transmission mechanism 8 is constructed as a multi-joint link mechanism including the rocker arm 15, the link arm 16 and the link rod 17.

Figure 3A:
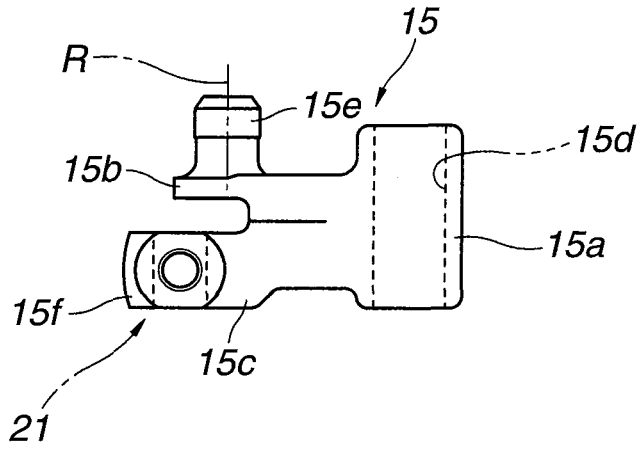
FIG. 3A is a plan view of a rocker arm provided in the first embodiment.
Figure 3B:
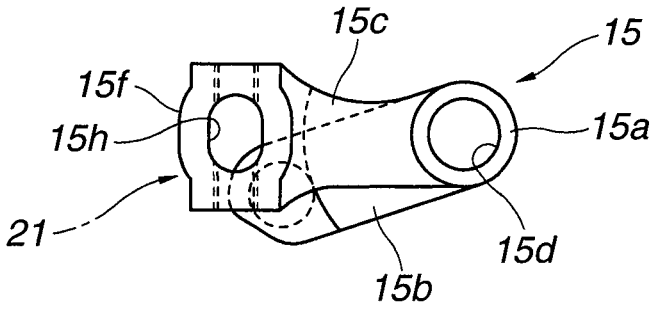
FIG. 3B is a cross sectional side view of the rocker arm.

As shown in FIGS. 3A and 3B, the rocker arm 15 includes a tubular base portion 15*a*, a first arm portion 15*b* and a second arm portion 15*c*. The tubular base portion 15*a* is located in one end side of the rocker arm 15, and is swingably supported by an after-mentioned control eccentric shaft 29. The first and second arm portions 15*b* and 15*c* are located in another end side of the rocker arm 15, and are provided to protrude approximately parallel to each other from an outer surface of the tubular base portion 15*a* toward an inside of the engine, in a biforked manner.

The tubular base portion 15*a* is formed with a support hole 15*d* passing through the tubular base portion 15*a*. The tubular base portion 15*a* is supported by causing the support hole 15*d* to be fitted over an after-mentioned outer circumference of the control eccentric shaft 29 through a minute clearance therebetween.

The first arm portion 15*b* is formed integrally with a shaft portion 15*e* that protrudes from an outside surface of tip portion of the first arm portion 15*b*. The shaft portion 15*e* is linked rotatably with an after-mentioned protruding end 16*b* of the link arm 16.

On the other hand, the second arm portion 15*c* includes a block portion 15*f* at a tip portion of second arm portion 15*c*. A lift adjusting mechanism 21 is provided to the block portion 15*f*. An after-mentioned one end portion 17*a* of the link rod 17 is linked rotatably with an after-mentioned pivotally-supporting pin 19 of the lift adjusting mechanism 21. Moreover, the block portion 15*f* is formed with an elongate hole (slot hole) 15*h* passing through the block portion 15*f* in a lateral direction of the block portion 15*f*. That is, the elongate hole 15*h* is formed to pass from one side of block portion 15*f* to another side of block portion 15*f* in the axial direction of drive shaft 4. The pivotally-supporting pin 19 is capable of moving within the elongate hole 15*h* in an upper-lower direction, i.e., moving along the elongate shape of hole 15*h*, for adjustment.

The first arm portion 15*b* and the second arm portion 15*c* are provided to have angles different from each other in a swinging direction of the rocker arm 15. That is, there is some angle between an imaginary linkage center line of the first arm portion 15*b* and an imaginary linkage center line of the second arm portion 15*c*. Also, the first arm portion 15*b* and the second arm portion 15*c* are positioned to deviate from each other in the upper-lower direction. The tip portion of first arm portion 15*b* is more inclined toward the lower direction by a slight inclination angle than the tip portion of second arm portion 15*c*.

As shown in FIGS. 1,2 and 4B, the link arm 16 includes an annular portion (circular tube portion) 16*a* and the protruding end 16*b*. The annular portion 16*a* has a relatively large diameter. The protruding end 16*b* is provided to protrude from a predetermined portion of outer circumferential surface of the annular portion 16*a*. A fitting hole 16*c* is formed at a center, portion of the annular portion 16*a*. The fitting hole 16*c* is fitted over an outer circumferential surface of the drive cam 5 so that the drive cam 5 rotatably supports the link arm 16.

The link rod 17 includes both rod portions located away from each other in the axial direction of drive shaft 4. These two rod portions are integrally formed by press molding. Hence, the link rod 17 is shaped like a U-shape in cross section. In order to attain a compactification inside the link rod 17, the link rod 17 is formed by being bent in an approximately circular-arc shape. The one end portion 17*a* (of each rod portion) of link rod 17 is connected with the second arm portion 15*c* through the pivotally-supporting pin 19 inserted into a pin hole of the one end portion 17*a*. The another end portion 17*b* of link rod 17 is connected rotatably with the connecting portion 7*c* of swing cam 7 through the connecting pin 18 inserted into a pin hole of the another end portion 17*b*. Moreover, since only one link rod 17 is provided to each cylinder of the engine, a structure of the valve control apparatus can be simplified while lightening a weight of the apparatus.

The swing cam 7 swings in the lifting direction when the link rod 17 raises (pulls up) the connecting portion 7*c*. Since the cam nose portion 7*b* that receives an input from the roller 34 is located on the opposite side of a swinging center of swing cam 7 from the connecting portion 7*c*, a generation of fall (inclination) of swing cam 7 can be suppressed.

As shown in FIGS. 1 and 2, the lift adjusting mechanism 21 includes the pivotally-supporting pin 19, an adjusting bolt 22, and a lock bolt 23. The pivotally-supporting pin 19 is provided in the elongate hole 15*h* of block portion 15*f* of second arm portion 15*c* of rocker arm 15. The adjusting bolt 22 is screwed into an adjusting female threaded hole from its lower side. This adjusting female threaded hole is drilled in a lower portion of the block portion 15*f* toward the elongate hole. Moreover, a fixing female threaded hole is drilled in an upper portion of the block portion 15*f* toward the elongate hole. The lock bolt 23 is screwed into the fixing female threaded hole from its upper side.

After an assembling of the respective structural elements, a fine adjustment for the lift amount of each intake valve 3*a*, 3*b* is carried out by adjusting an up-down position of the pivotally-supporting pin 19 within the elongate hole 15*h* (a position set along elongate shape of the elongate hole 15*h*) by use of the adjusting bolt 22. After this fine adjustment, the position of pivotally-supporting pin 19 is fixed (fastened) by tightening the lock bolt 23.

The control mechanism 9 includes a control shaft 24 and an electric actuator (not shown). The control shaft 24 is disposed parallel to the drive shaft 4, in a region above the drive shaft 4. The electric actuator is an actuator for driving a rotation of the control shaft 24.

As shown in FIGS. 1, 2 and 4A-4C, the control shaft 24 includes a control pivot shaft 24*a* and a plurality of control eccentric cams 25. The plurality of control eccentric cams 25 are provided to every cylinder, and are arranged on an outer circumference of the control pivot shaft 24*a*. The plurality of control eccentric cams 25 function as a swing fulcrum of the rocker arm 15.

The control pivot shaft 24*a* includes concave portions 24*b* and 24*c* formed at a location corresponding to the rocker arm 15. Each concave portion 24*b*, 24*c* is formed to have two surfaces opposed to each other in the axial direction of drive shaft 4 through an axial width. Two bolt-insertion holes 26*a* and 26*b* are formed to pass through the control pivot shaft 24*a* in a radial direction of control pivot shaft 24*a*, in an existing range of the concave portions 24*b* and 24*c*. That is, each of the bolt-insertion holes 26*a* and 26*b* is formed between the both concave portions 24*b* and 24*c*. These bolt-insertion holes 26*a* and 26*b* are provided to have a predetermined distance from each other in the axial direction. Each of the concave portions 24*b* and 24*c* is formed to extend in the axial direction of control pivot shaft 24*a*, and a bottom surface of each concave portion 24*b*, 24*c* is formed flat.

The plurality of control eccentric cams 25 are constituted by a bracket 28 and the control eccentric shaft 29. The bracket 28 is fixed to the concave portion 24*b* of control shaft 24 by two bolts 27 and 27. The two bolts 27 and 27 are inserted into the two bolt-insertion holes 26*a* and 26*b* from the side of concave portion 24*c*. The control eccentric shaft 29 is fixed to an tip side of the bracket 28.

The bracket 28 is formed by being bent (by means of bending forming) in an angular-U shape as viewed in a direction perpendicular to the axial direction of control pivot shaft 24*a* and parallel to the bottom surface of each concave portion 24*b*, 24*c*. The bracket 28 includes a rectangular-shaped base portion 28*a* and arm-shaped fixing portions 28*b* and 28*b*. The bracket 28 (the base portion 28*a*) is formed to extend in a longitudinal direction of the concave portion 24*b*. The base portion 28*a* is fitted into the concave portion 24*b*, and thereby, is held by the concave portion 24*b*. The arm-shaped fixing portions 28*b* and 28*b* are provided to both end portions of the bracket 28 relative to a longitudinal direction of bracket 28. That is, the arm-shaped fixing portions 28*b* and 28*b* protrude from the both end portions of bracket 28 in a lower direction of FIG. 2.

The base portion 28*a* is formed with female threaded holes in both end-portion sides of base portion 28*a* relative to the longitudinal direction. Tip potions of the bolts 27 and 27 are screwed respectively into the female threaded holes of base portion 28*a*. Each of the both fixing portions 28*b* and 28*b* is formed with a fixing hole 28*c* in a tip portion of the fixing portion 28*b*. Each fixing hole 28*c* passes through the fixing portion 28*b*, and serves to fasten the control eccentric shaft 29. Moreover, since an outer surface of the base portion 28*a* is in contact with the bottom surface of concave portion 24*b*, and respective outer edge surfaces of both fixing portions 28*b* and 28*b* are closely in contact with opposed inner surfaces of concave portion 24*b*, i.e., is fitted to and held by the opposed inner surfaces of concave portion 24*b*; an accuracy of positioning is enhanced relative to the longitudinal direction.

(An outer circumferential surface of) the control eccentric shaft 29 swingably supports the rocker arm 15 through the support hole 15*d* of tubular base portion 15*a* of rocker arm 15. An axial length L of the control eccentric shaft 29 is set to be approximately equal to a distance between the respective axially-outside surfaces (outer edge surfaces) of the both fixing portions 28*b* and 28*b* of bracket 28. The control eccentric shaft 29 is fixed to the both fixing portions 28*b* and 28*b*, e.g., by forcibly inserting both end portions of control eccentric shaft 29 respectively into the fixing holes 28*c* and 28*c*. A shaft center Q of the control eccentric shaft 29 serves as a swinging fulcrum of the rocker arm 15.

As shown in FIG. 2, axially-outside surfaces of the cam main body 5*a* of drive cam 5, axially-outside surfaces of the link rod 17 and axially-outside surfaces of the swing cam 7 exist within a range of the length L of control eccentric shaft 29, as viewed in a direction perpendicular to the axial direction of drive shaft 4.

As shown in FIGS. 4A to 4C, the shaft center Q of control eccentric shaft 29 is eccentric to (deviated from) a shaft center P of the control pivot shaft 24*a* by a relatively large eccentric amount a because of an arm length of each fixing portion 28*b* of bracket 28. In other words, the control eccentric shaft 29 is formed in a crank shape by use of the bracket 28 relative to the shaft center P of control pivot shaft 24*a*. Hence, the eccentric amount a can be set at a sufficiently large value.

The electric actuator includes an electric motor and a speed reducer (not shown). The electric motor is fixed to a rear end portion of the cylinder head 1. The speed reducer is, for example, a ball screw mechanism for transmitting a rotational drive force of the electric motor to the control pivot shaft 24*a*.

The electric motor is a proportional DC motor. This electric motor is driven by control signals that are outputted from the electronic controller 49 configured to detect the operating state of engine.

The electronic controller 49 detects the current operating state of engine, e.g., by calculations using the above-mentioned crank angle sensor for sensing the engine rotational speed, the air flow meter for sensing an amount of intake air, the water-temperature sensor for sensing a water temperature of the engine or the like. Moreover, the electronic controller 49 detects an operational position of the variable mechanism by receiving information signals derived from a potentiometer for sensing a rotational position of the control shaft 24, and the like. Thereby, the electronic controller 49 controls the electric motor by way of feedback control. Since such an electric actuator uses electricity, a prompt responsivity in change can be obtained irrespective of oil temperature of engine and the like.

The electric actuator controls the valve lift-amount characteristic and the working angle of the intake valve 3*a* continuously within a range from a minimum value of working angle to a maximum value of working angle, by controlling the rotational position of control pivot shaft 24*a* in accordance with the operating state of engine. That is, a positional relation among the shaft center P of control pivot shaft 24*a*, a shaft center R of the shaft portion 15*e* of rocker arm 15, a shaft center S of the pivotally-supporting pin 19 and the like is assigned (determined) in accordance with the rotational position of control pivot shaft 24*a*. Thereby, an opening timing of valve-lift characteristic is varied toward an advanced side when controlling the midpoint of working angle.

Operations of the valve control apparatus according to the first embodiment will now be explained. At first, for example, at the time of idling of the engine or at the time of low-load operation of the engine (in a low-load running region of vehicle), the connection changeover mechanism 36 does not connect the secondary swing arm 31 with the primary swing arm 30 in each cylinder.

That is, the electronic controller 49 does not output the control signal to the electromagnetic changeover valve 48, so that the hydraulic-pressure supply/discharge passage 43 communicates with (i.e., is open to) the drain passage 47 and does not communicate with (i.e., is closed to) the supply passage 46. Hence, hydraulic pressure is not supplied to the pressure-receiving chamber 40. As shown in FIG. 2, whole of the plunger 38 is maintained at its backward position by spring force of the coil spring 39. That is, the plunger 38 is held within the first retaining hole 37*a* by the biasing force of the coil spring 39. Thereby, the primary swing arm 30 is not interlocked with the secondary swing arm 31. In this state, the secondary swing arm 31 is in contact with the stem end of second intake valve 3*b* under its own weight.

At this time, because of the output of control signal from the electronic controller 49 to the electric motor, the control pivot shaft 24*a* has been rotated to a clockwise-directional position θ1 by the ball screw mechanism, as shown in FIGS. 4A to 5C. Hence, the control eccentric shaft 29 has reached its position corresponding to the position θ1. The shaft center Q has moved away from the drive shaft 4 in an upper left direction of FIG. 4A. Thereby, whole of the transmission mechanism 8 has tilted around the drive shaft 4 in a counterclockwise direction. Hence, also the swing cam 7 has rotated in the counterclockwise direction so that a base-circular-surface side of the cam surface 7*d* is in contact with the roller 34 of primary swing arm 30.

Figures 5A, 5B, 5C:
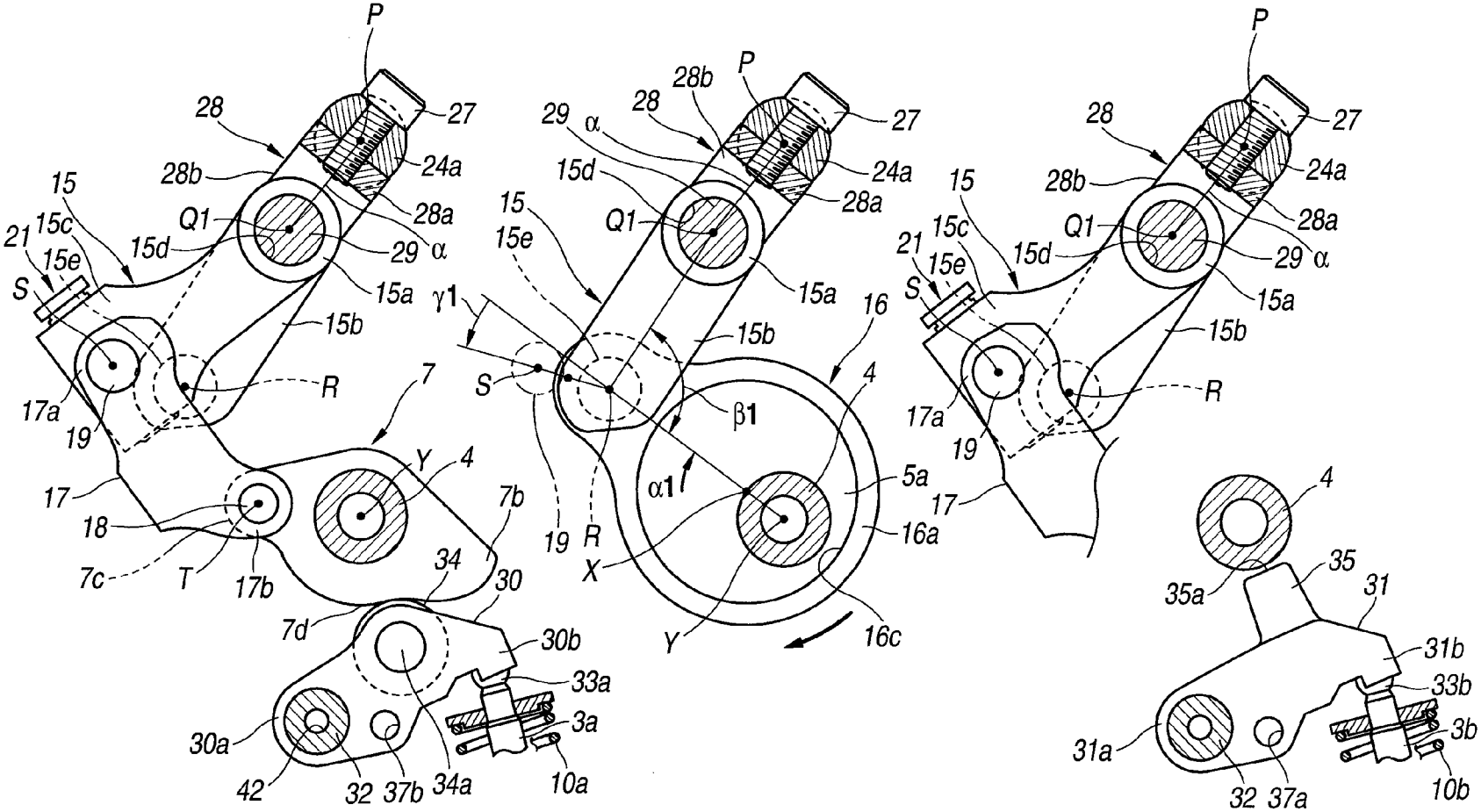
FIGS. 5A to 5C are cross sectional views under the minimum working angle.

When the rocker arm 15 is raised upwardly by the link arm 16 in response to the rotation of drive cam 5 from the state shown by FIG. 4A, the connecting portion 7*c* of swing cam 7 is lifted upwardly by the link rod 17 to rotate the swing cam 7 in the clockwise direction, as shown in FIG. 5A. This lift is transmitted through the roller 34 of primary swing arm 30 to the first intake valve 3*a*. Accordingly, the first intake valve 3*a* is lifted. However, at this time, both of the lift amount and working angle of the first intake valve 3*a* are sufficiently small.

Figure 10:
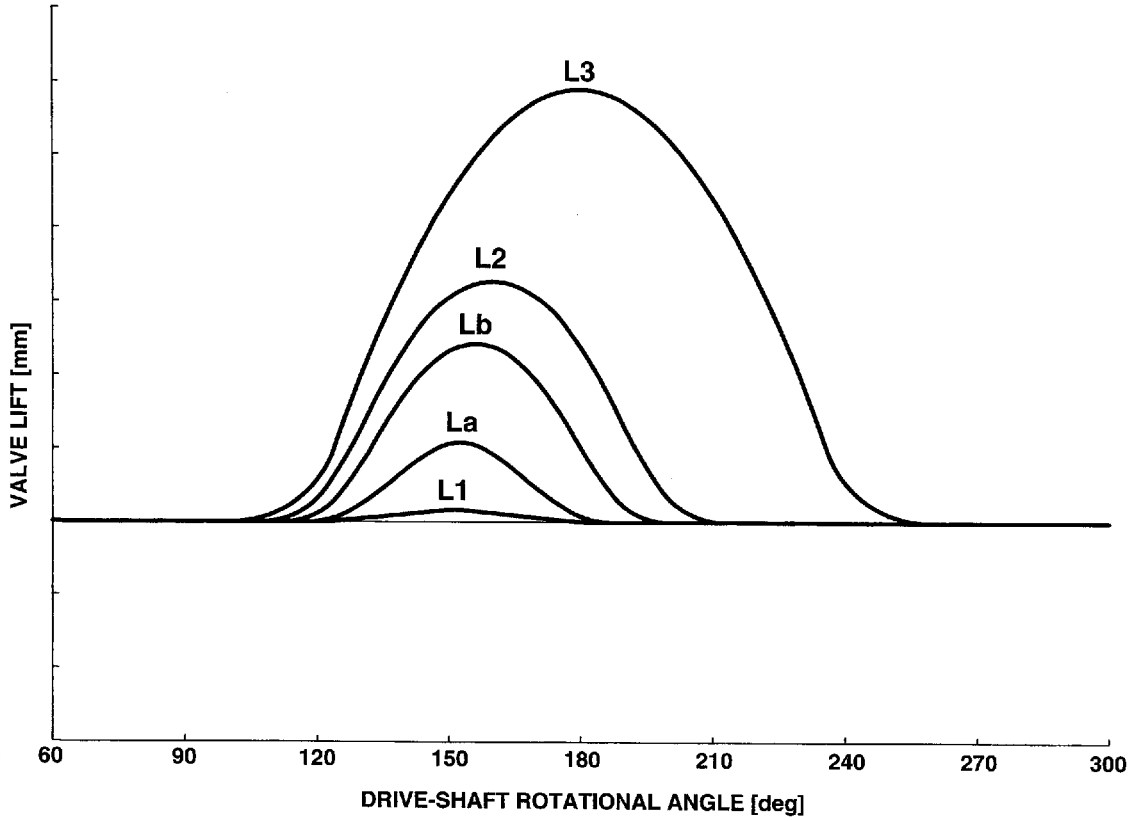
FIG. 10 is a lift-curve characteristic view of the first intake valve in the first embodiment.

Thus, in this operating region of the engine, a valve lift amount (characteristic) L1 of first intake valve 3*a* is sufficiently small as shown in FIG. 10. Therefore, the opening timing of first intake valve 3*a* is delayed so that a valve overlap between the intake valve 3*a* and an exhaust valve is avoided. Hence, an improvement of combustion and the like can be obtained to attain an enhancement of fuel economy and a stable rotation of the engine.

At this time, the secondary swing arm 31, i.e., the lower surface of shim 33*b* of tip portion 31*b* is in contact with the upper surface of stem end of secondary swing arm 31 under its own weight, as shown in FIGS. 4C and 5C. That is, the secondary swing arm 31 does not conduct the lift operation so that the lift action of second intake valve 3*b* does not occur. Thus, the second intake valve 3*b* remains in the closed state by the biasing force of valve spring 10*b*.

Hence, as shown in FIG. 5A, intake air is supplied into the cylinder only by the first intake valve 3*a* which is in the above-mentioned minimum lifted state. Therefore, an induction swirl effect of intake air becomes large to improve the combustion, while sufficiently reducing pumping loss and frictions in the valve system. As a result, the fuel economy can be enhanced.

Moreover, as mentioned later, a lift-operation accuracy for the first intake valve 3*a* is high. Also from this point of view, the combustion can be stabilized so that the fuel economy can be further improved.

At this time, the upper surface 35*a* of stopper convex portion 35 of secondary swing arm 31 is not in contact with the outer circumferential surface of the drive shaft 4, but faces the outer circumferential surface of the drive shaft 4 through a minute clearance, as shown in FIGS. 4C and 5C. Therefore, a generation of friction between the drive shaft 4 and the stopper convex portion 35 is suppressed.

Figures 6A, 6B, 6C:
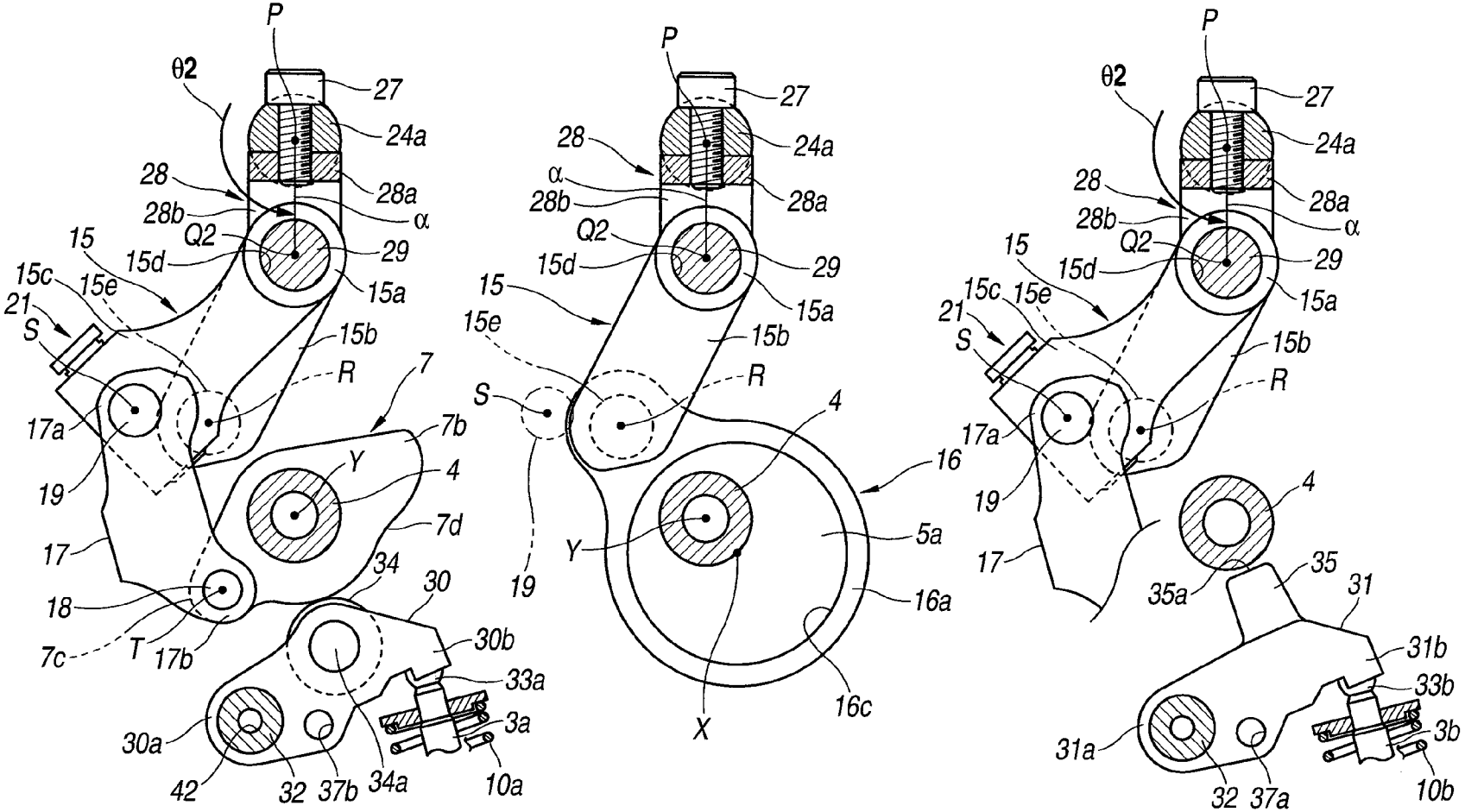
FIGS. 6A to 6C are cross sectional views under a middle working angle.
Figures 7A, 7B, 7C:
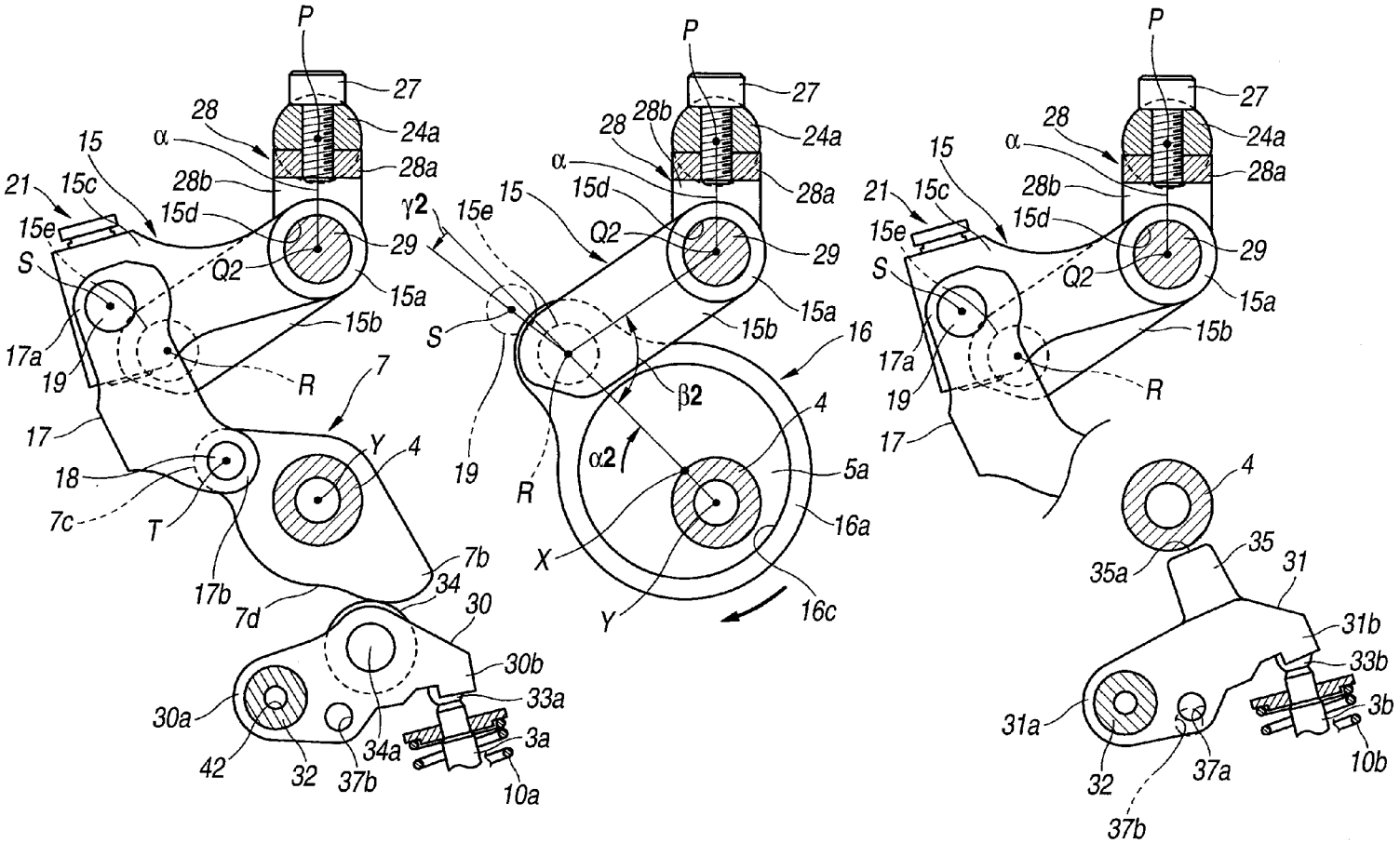
FIGS. 7A to 7C are cross sectional views under the middle working angle.

Next, a case where the state of engine has changed to a low-and-middle rotational speed region or a low-and-middle partial load region because of a steady-state running of vehicle or the like will now be explained. In such a case, the connection changeover mechanism 36 still does not connect the secondary swing arm 31 with the primary swing arm 30 in each cylinder. As shown in FIGS. 6C and 7C, the secondary swing arm 31 is in contact with the stem end of second intake valve 3*b* through the lower surface of shim 33*b* of tip portion 31*b*, under its own weight.

In this case, the control shaft 24 has rotated in the counterclockwise direction up to its position θ2 by the electric actuator on the basis of the control signal derived from the electronic controller 49 as shown in FIGS. 6A to 7C. Also, the control eccentric shaft 29 has rotated up to the position θ2. Thereby, the shaft center Q2 of the control eccentric shaft 29 has become closest (nearest) to the drive shaft 4.

Accordingly, whole of the transmission mechanism 8 including the rocker arm 15, the link arm 16 and the like has rotated around the drive shaft 4 in the clockwise direction. Hence, also the swing cam 7 has rotated relatively in the clockwise direction (lifting direction).

As shown in FIGS. 7A and 7B, when the rocker arm 15 is raised upwardly by the link arm 16 in response to the rotation of drive cam 5, a lift of the drive cam 7 is transmitted through the primary swing arm 30 to the first intake valve 3*a*. Accordingly, the first intake valve 3*a* is lifted. Thus, in the low- and middle load region or the low-and-middle rotational speed region of the engine, the valve lift amount and the working angle of the first intake valve 3*a* are increased as shown in FIG. 10. Therefore, in this engine region, a middle lift amount L2 and a middle working angle of the first intake valve 3*a* are obtained.

At this time, the secondary swing arm 31 maintains the second intake valve 3*b* in the closed state by the biasing force of valve spring 10*b*.

Thus, the secondary swing arm 31 does not carry out the lift operation, so that the second intake valve 3*b* remains in the closed state. That is, only the opening/closing operation of first intake valve 3*a* is carried out by the primary swing arm 30. Therefore, the induction swirl effect of intake air is large to attain a preferable combustion state. Moreover, since the lift amount L2 of first intake valve 3*a* and the working angle of first intake valve 3*a* are relatively small, the frictions and the pumping loss in the valve system can be reduced (the closing timing of first intake valve 3*a* is located at a relatively advanced side as shown in FIG. 10). Also from this point of view, the fuel economy can be improved.

At this time, the upper surface 35*a* of stopper convex portion 35 of secondary swing arm 31 is not in contact with the outer circumferential surface of the drive shaft 4.

Next, a case where the state of engine has changed to a high rotational speed region or a high load region will now be explained. In such a case, the electromagnetic changeover valve 48 communicates the hydraulic-pressure supply/discharge passage 43 with the supply passage 46 and blocks the communication between the hydraulic-pressure supply/discharge passage 43 and the drain passage 47, by the signal outputted from the electronic controller 49. Thereby, high-pressure oil is supplied to the pressure-receiving chamber 40, so that the front-end portion 38*a* of the plunger 38 is inserted into the second retaining hole 37*b* so as to engage with the primary swing arm 30 when the primary swing arm 30 is not being lifted.

That is, at this time, the secondary swing arm 31 is in non-lifted state. Hence, when the primary swing arm 30 is also in the non-lifted state, the first retaining hole 37*a* conforms to the second retaining hole 37*b*. Therefore, when both of the primary and secondary swing arms 30 and 31 are in the non-lifted state, the plunger 38 moves in the right direction of FIG. 2 against the biasing force of coil spring 39 so that the front-end portion 38*a* enters the second retaining hole 37*b* to be engaged. Accordingly, the primary swing arm 30 is integrally connected (interlocked) with the secondary swing arm 31, so that the primary swing arm 30 repeats the lifting operation and its returning operation in synchronization with the secondary swing arm 31.

Under this case, the control pivot shaft 24*a* has rotated in the counterclockwise direction up to a position θ3 by the ball screw mechanism because the control signal has been outputted from the electronic controller 49 to the electric motor, as shown in FIGS. 8A to 9C. Hence, the control eccentric shaft 29 has reached its position corresponding to the position θ3. The shaft center Q has moved away from the drive shaft 4 in an upper right direction of FIG. 8A. Thereby, whole of the transmission mechanism 8 has tilted around the drive shaft 4 in the clockwise direction. Hence, also the swing cam 7 has rotated in the clockwise direction around the drive shaft 4, so that the contact point between the cam surface 7*d* and the roller 34 of primary swing arm 30 has approached a lift-surface side of cam surface 7*d*.

Figure 8A:
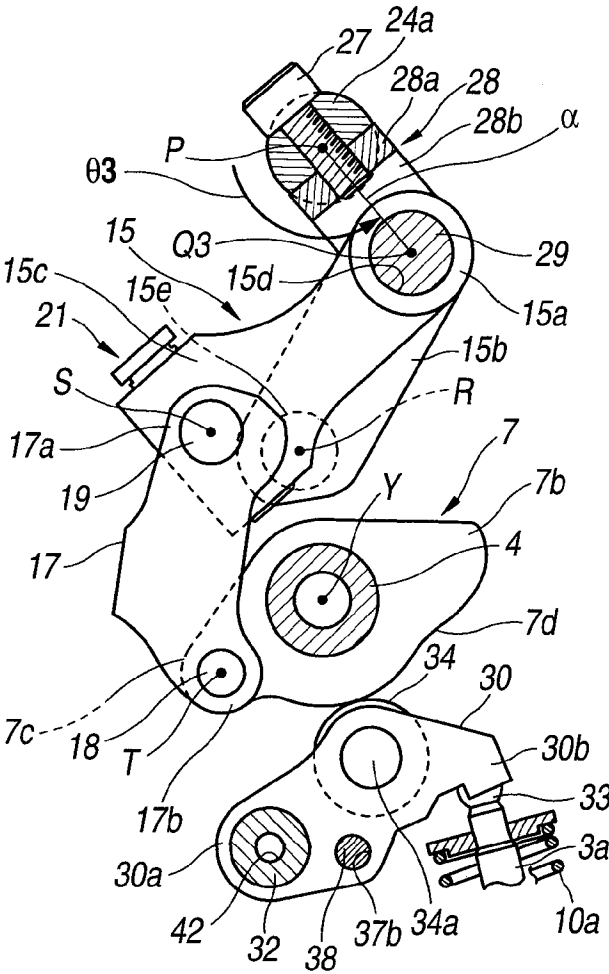
FIGS. 8A to 8C are cross sectional views under a maximum working angle.
Figure 8B:
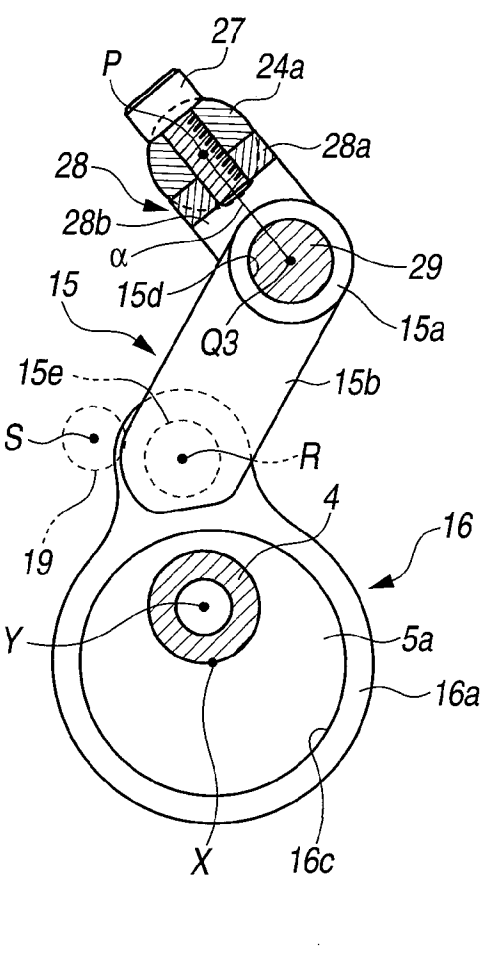
Figure 8C:
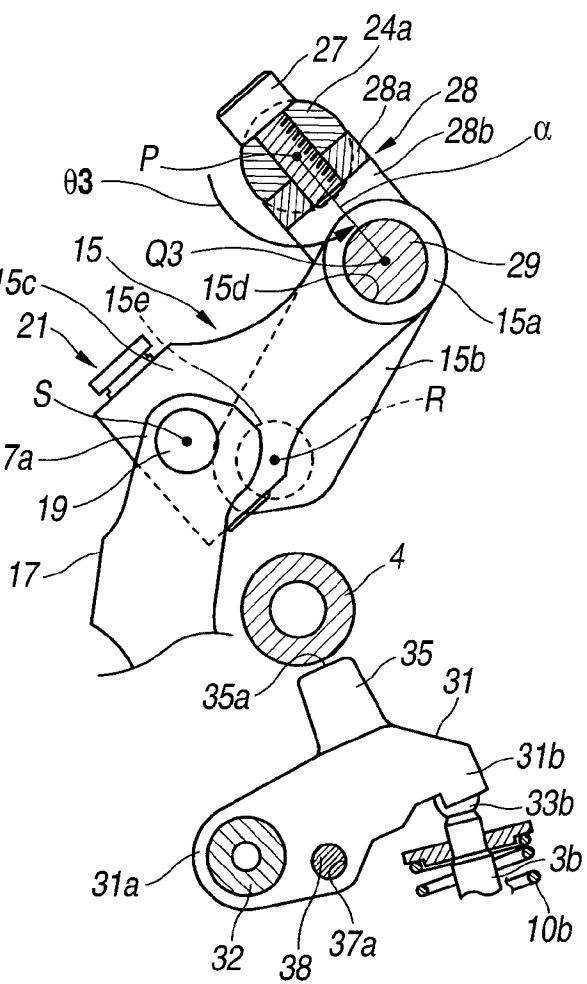
Figures 9A, 9B, 9C:
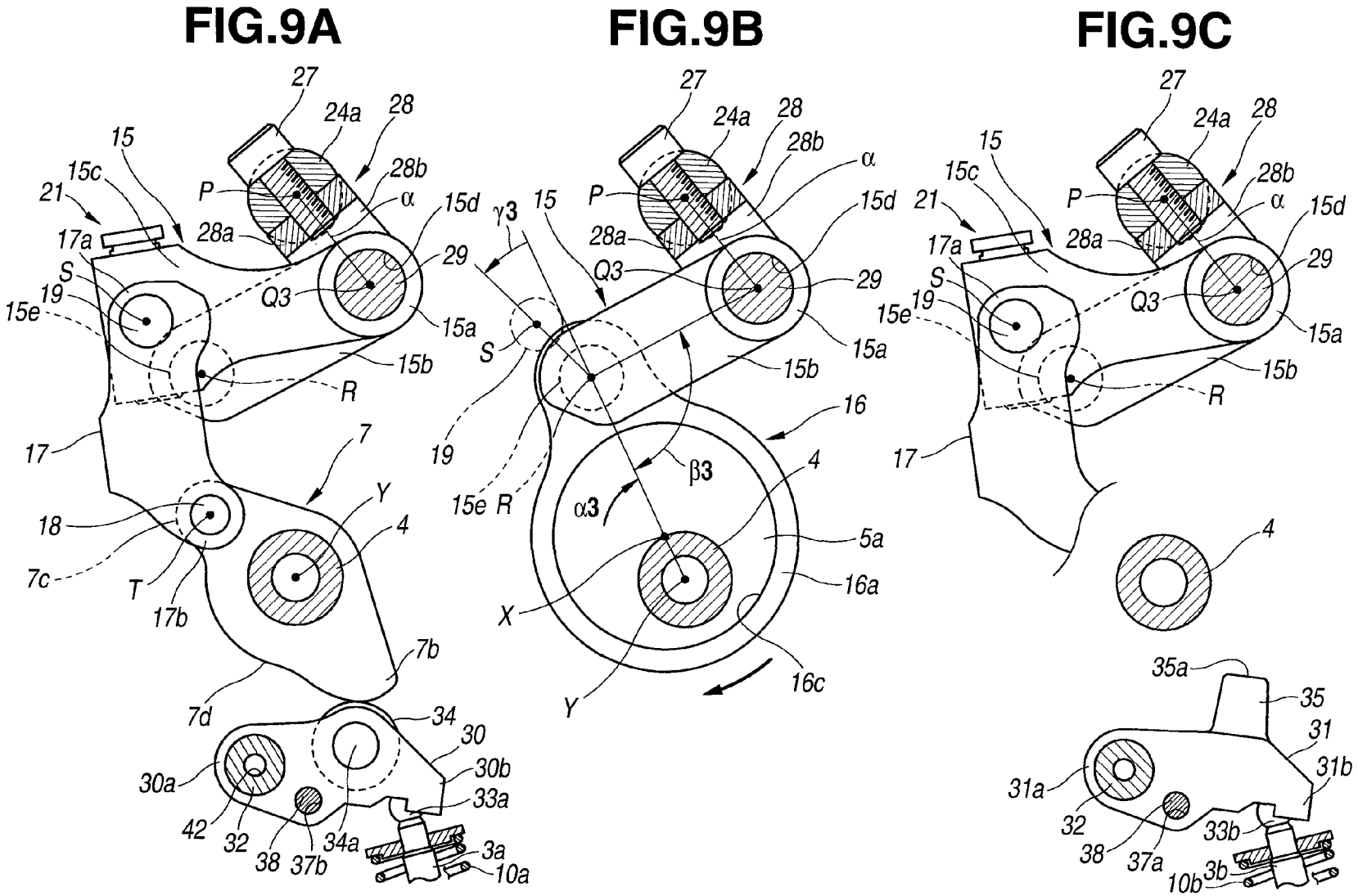
FIGS. 9A to 9C are cross sectional views under the maximum working angle.

When the rocker arm 15 is raised upwardly by the link arm 16 in response to the rotation of drive cam 5 from the state shown by FIG. 8A, the connecting portion 7*c* of swing cam 7 is lifted upwardly by the link rod 17 to rotate the swing cam 7 in the clockwise direction, as shown in FIG. 9A. This lift is transmitted through the roller 34 of primary swing arm 30 to the first intake valve 3*a*. Accordingly, the first intake valve 3*a* is lifted. At the same time, the second intake valve 3*b* is lifted together by the secondary swing arm 31. The lift amount of the first and second intake valves 3*a* and 3*b* becomes sufficiently large.

Thus, in this operating region of engine, a valve lift amount L3 of the first and second intake valves 3*a* and 3*b* is sufficiently large as shown in FIG. 10. Therefore, a sufficient intake air flows into the cylinder from the both intake ports. Accordingly, the generation of intake-air swirl is suppressed in the cylinder, so that a reduction of intake-air charging efficiency due to the intake-air swirl is suppressed. Because this intake-air charging efficiency is enhanced, torque or output power can be sufficiently enlarged when accelerating the vehicle.

Particularly, in this case, not only the lift amount of first intake valve 3*a* but also a lift curve of first intake valve 3*a* are same as those of the second intake valve 3*b*. Hence, an intake-air swirl which occurs during the lifting action can also be suppressed. As a result, the intake-air charging efficiency can be further enhanced.

At this time, the stopper convex portion 35 of secondary swing arm 31 is not in contact with the outer circumferential surface of drive shaft 4. However, in a case that an abnormal swing (unusual motion) of the secondary swing arm 31 is caused due to, for example, a flick phenomenon generated when the plunger 38 is inserted into and engaged with the second retaining hole 37*b* or when the plunger 38 is pulled out of the second retaining hole 37*b*; the upper surface 35*a* of stopper convex portion 35 becomes in contact with the outer circumferential surface of drive shaft 4. Therefore, an excessive swing of secondary swing arm 31 is restricted in the upper direction.

When comparing the attitude of FIG. 8A with the attitude of FIG. 9A as to the swing motion of swing cam 7, the swing cam 7 generates a large and abrupt variation of angular speed in swing angle. That is, in this case, an angular acceleration is large. Accordingly, in a case that an inertia Ip of swing cam is large, an inertial load which is applied to the link rod 17 and the like is large. Particularly, the inertial load becomes large at a timing of peak lift (inversely change point of swinging direction). Thereby, there is a possibility that the case where the inertia Ip of swing cam is large has a disadvantage in this high-rotational-speed region. Contrary to this, in the valve control apparatus of the first embodiment according to the present invention, the two intake valves 3*a* and 3*b* are opened/closed by the single swing cam 7. Therefore, the inertia Ip of the swing cam 7 can be reduced to reduce the inertial load, so that the valve control apparatus in the first embodiment has an advantage in the high-rotational-speed region. As a result, the maximum rotational speed of the engine can be set at a high value so that a sufficient output of the engine can be obtained.

Figure 11:
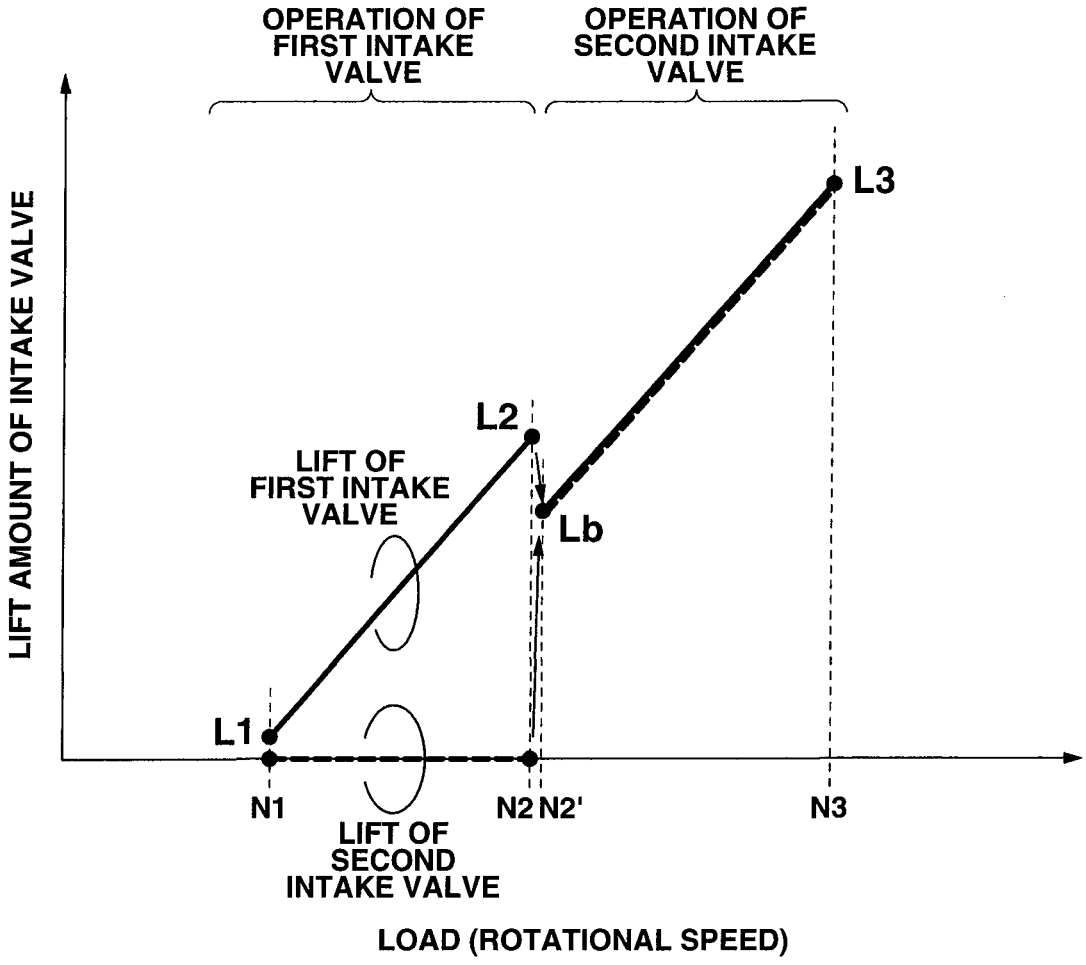
FIG. 11 is a valve-lift characteristic view of the first and second intake valves in the first embodiment.

FIG. 11 shows a variation characteristic of the lift amounts (lift-peak values) of the first and second intake valves 3*a* and 3*b*, when varying the engine load (or engine rotational speed). In FIG. 11, solid lines represent the variation of lift amount of first intake valve 3*a*, and dotted lines represent the variation of lift amount of second intake valve 3*b*.

The second intake valve 3*b* is not lifted at all in a range from the minimum lift amount L1 to the middle lift amount L2 of the first intake valve 3*a*. That is, the second intake valve 3*b* is maintained in the closed state when the first intake valve 3*a* has a characteristic between the minimum lift amount L1 and the middle lift amount L2 shown in FIG. 10. In a case that the load or the rotational speed of engine is higher than that for the middle lift amount L2 (from a middle lift amount Lb to the maximum lift amount L3), the second intake valve 3*b* is lifted so as to have the lift amount same as that of the first intake valve 3*a*.

FIG. 11 shows the solid line by slightly shifting the solid line from the dotted line, between the lift amount Lb and the lift amount L3. However, actually, the lift amount of first intake valve 3*a* (solid line) is approximately equal to the lift amount of second intake valve 3*b* (dotted line), between the lift amount Lb and the lift amount L3. Strictly speaking, a relative position between the primary swing arm 30 and the secondary swing arm 31 can be varied slightly due to a clearance between the plunger 38 and each retaining hole 37*a*, 37*b*. However, this variation of relative position has a very slight magnitude, and therefore, the lift amount of first intake valve 3*a* (solid line) and the lift amount of second intake valve 3*b* (dotted line) can be regarded as being substantially equal to each other.

As shown in FIG. 11, a point N1 exists in the above-mentioned idling operation or low load region. In this region, a favorable fuel-saving effect can be attained because of the swirl effect which is obtained by closing the second intake valve 3*b* by means of the secondary swing arm 31. A point N2 exists in the low-and-middle partial load or the low-and-middle rotational speed region under the steady-state running of vehicle. Also in this region, a favorable fuel-saving effect can be attained because of the swirl effect which is obtained by the closed state of second intake valve 3*b*. A point N3 exists in the high rotational speed region or high load region under a rapid acceleration of vehicle or the like. The both intake valves 3*a* and 3*b* operate to have the same lift amount and the same lift curve as each other. Thereby, the intake-air charging efficiency can be increased to a maximum extent to enhance the torque and output power of the engine. Moreover, because the swirl is sufficiently suppressed, a high-load knocking can be suppressed. From this point of view, the torque and output power can be sufficiently increased.

Next, the changeover between the operation by only the first intake valve 3*a* and the operation by the first and second intake valves 3*a* and 3*b* will now be supplementarily explained. When the load state (rotational speed state) approaches a point N2' which is given for a load or a rotational speed slightly higher than that of the point N2, the plunger 38 moves so as to connect the primary swing arm 30 with the secondary swing arm 31. Thereby, the operation using both the first intake valve 3*a* and second intake valve 3*b* is started. Thereby, an suction air amount in the cylinder is rapidly increased to increase the torque. Hence, this torque change is suppressed by carrying out a control of retarding an ignition timing (for torque reduction) or the like. Then, the current lift-amount characteristic for the two intake valves 3*a* and 3*b* is reduced toward the lift amount Lb while bringing the ignition timing back to an advance side.

Thus, a transient torque shock which is caused by the changeover between the operation of one intake valve 3*a* and the operation of two intake valves 3*a* and 3*b* can be suppressed.

A lift area (surface integral) of the lift curve of lift amount Lb relative to time is approximately half of a lift area of the lift curve of lift amount L2 relative to time. Therefore, a difference of steady-state torques before and after the changeover between the one-valve operation and the two-valve operation is suppressed, in addition to the suppression of transient torque shock as mentioned above.

Thus, according to the first embodiment, the fuel economy can be improved by producing the intake-air swirl in the cylinder when the second intake valve 3*b* is not in operation under the engine idling, the low-and-middle partial load region or the like. Additionally, according to this embodiment, the lift accuracy of first intake valve 3*a* can be improved, and the combustion can be stabilized. Accordingly, an operation under further small lift amount and further small working angle becomes possible. As a result, the friction and pumping loss in the valve system can be further reduced. Thereby, a further fuel saving can be achieved.

As shown in FIG. 2, the axis Z of first intake valve 3*a* is located within the width range of swing cam 7 (i.e., within a length of swing cam 7 relative to the axial direction of drive shaft 4). Hence, a swing power point at which the swing cam 7 is applied to the primary swing arm 30 is located at an approximately center of width range of the roller 34 of primary swing arm 30. Accordingly, the generation of fall (inclination) of primary swing arm 30 in the axial direction of rocker shaft 32 is sufficiently suppressed during the operation of swing cam 7, so that a stable lift operation of first intake valve 3*a* can be attained. Therefore, the stabilization of engine combustion is further improved to further promote the reduction of fuel consumption. This is also the reason why the above-mentioned operation under further small lift amount and further small working angle becomes possible.

Moreover, as shown in FIG. 2, in addition to the first bearing portion 11*a* that supports the drive shaft 4 near the drive cam 5 as a bearing for the drive shaft 4, the second bearing portion 11*b* disposed near the left portion (in FIG. 2) of swing cam 7 is provided in this embodiment. Accordingly, a distance between both the bearing portions 11*a* and 11*b* becomes short. Hence, a support-shaft deflection (deformation) of the swing cam 7 can be reduced, so that the lift action (swing) of swing cam 7 can be further stabilized.

[Second Embodiment]

Figure 12:
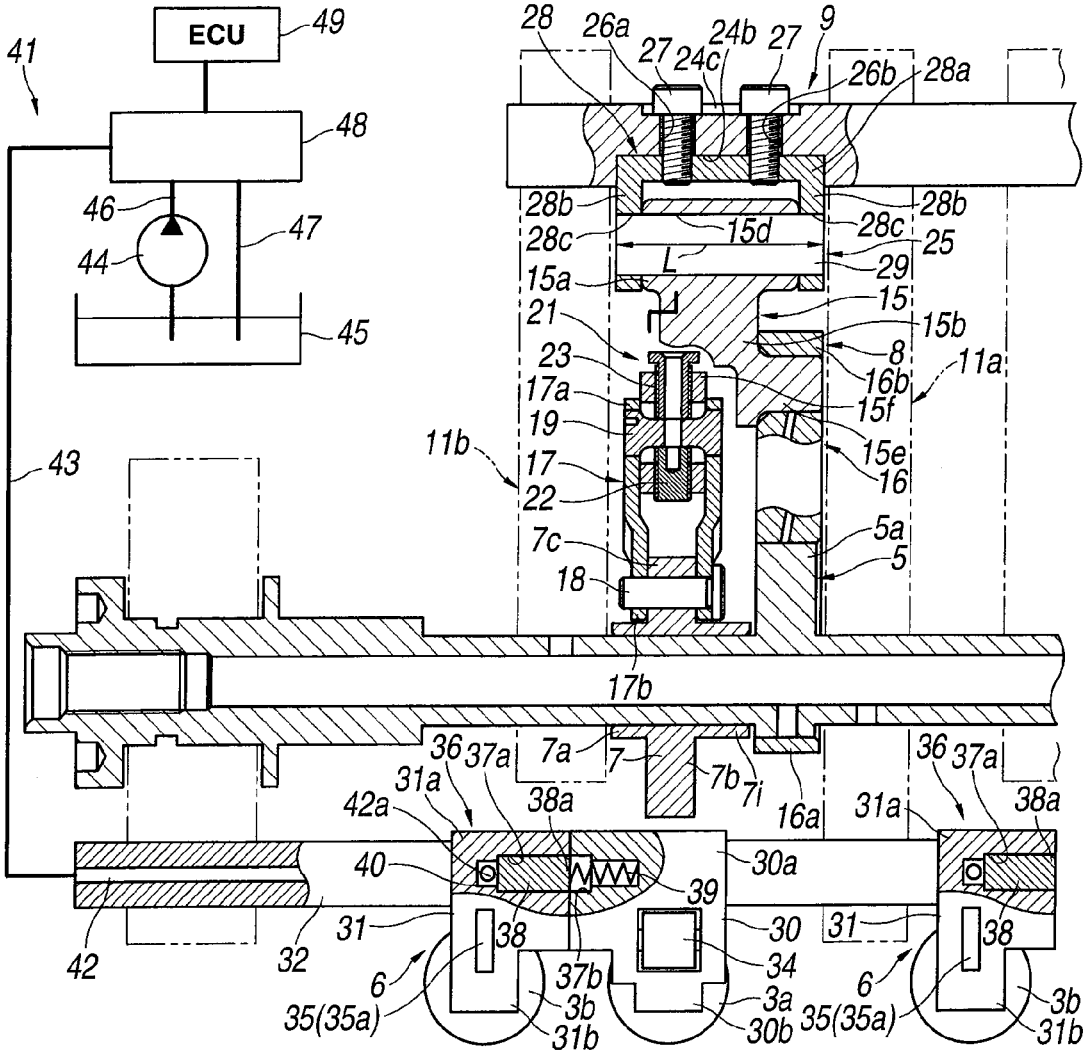
FIG. 12 is a cross sectional view of main parts of a valve control apparatus in a second embodiment according to the present invention.
Figure 13:
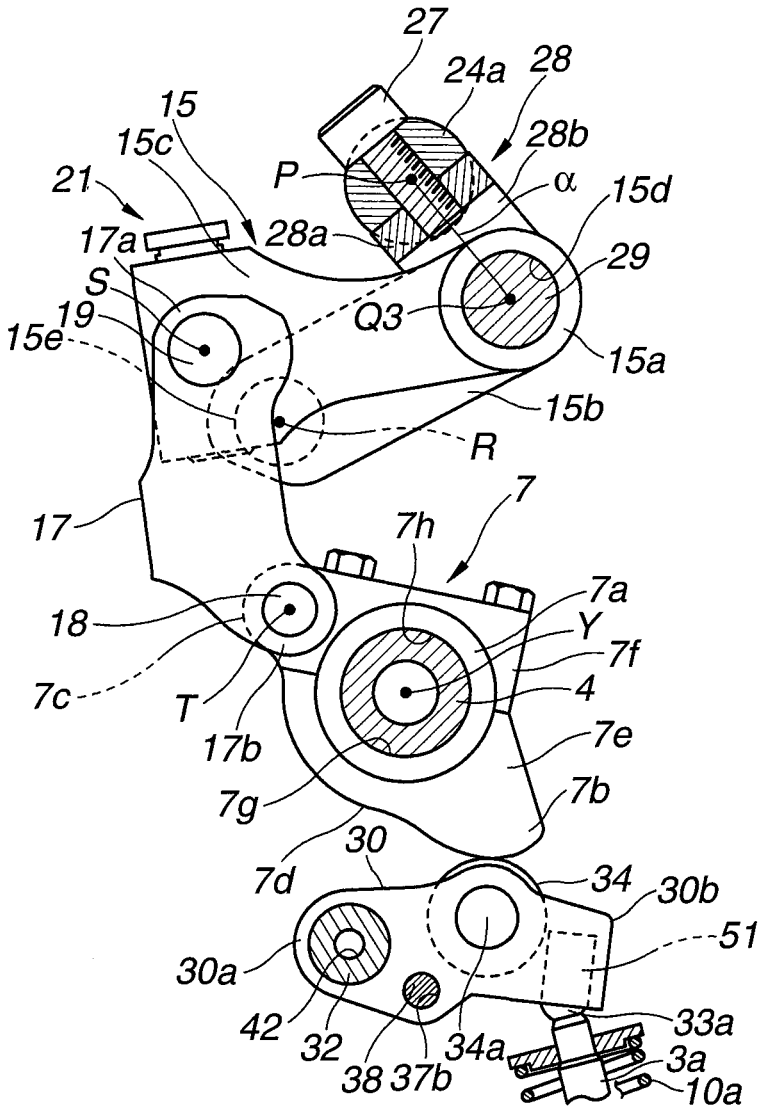
FIG. 13 is a partial cross sectional view showing a swing cam and a side of primary swing arm in the second embodiment.

FIGS. 12 and 13 show a valve control apparatus in a second embodiment according to the present invention. In the second embodiment, the drive cam 5 is formed integrally with the drive shaft 4, and the swing cam 7 including the cam shaft 7*a* is formed separately, i.e., to be able to be separated into two pieces via its base end portion (located between the connecting portion 7*c* and the cam nose portion 7*b*).

That is, the drive cam 5 is formed integrally with the drive shaft 4 when molding the drive shaft 4 by means of forging, casting or the like. However, in the case that the drive cam 5 is integrally molded with the drive shaft 4, the drive shaft 4 cannot be inserted into the plurality of swing cams 7 sequentially from the end portion of drive shaft 4 due to the existence of the drive cams 5, when trying to attach the plurality of swing cams 7 to the drive shaft 4.

Therefore, in the second embodiment, as shown in FIG. 13, the swing cam 7 is formed as two separate pieces of a cam main body 7*e* and a bracket member 7*f*. These cam main body 7*e* and the bracket member 7*f* are dividable at the base end portion side of swing cam 7 (located between the connecting portion 7*c* and the cam nose portion 7*b*). The cam main body 7*e* has the cam surface 7*d*. Each of these cam main body 7*e* and bracket member 7*f* includes a bearing groove 7*g*, 7*h* formed in a half-round shape. The bearing grooves 7*g* and 7*h* are fitted over the drive shaft 4 from a radially outside of drive shaft 4 so as to face each other, and under this state, the bracket member 7*f* is combined with the cam main body 7*e* by using two bolts 50 and 50.

As mentioned above, since the drive cam 5 is provided integrally with the drive shaft 4, a support stiffness of the drive cam 5 becomes high so that a lift behavior can be stabilized. Moreover, because the fixing pin 12 as mentioned in the first embodiment becomes unnecessary, the number of components and the cost of manufacturing can be reduced.

Moreover, as shown in FIG. 12, one end portion of the cam shaft 7*a* of swing cam 7 which is located on the side of drive cam 5 is formed to extend in the axial direction. A front edge of this extension portion 7*i* is located near one lateral surface of the drive cam 5. Thus, by providing the extension portion 7*i*, the fall of swing cam 7 in the axial direction can be suppressed during its swinging motion. Moreover, by removing a sleeve 2 which is provided in the first embodiment, the number of components can be reduced.

Moreover, as shown in FIG. 13, a hydraulic lash adjuster 51 for adjusting a clearance between the stem end of first intake valve 3*a* and the shim 33*a* to become equal to 0 is disposed and held in a receiving groove formed in a lower portion of the tip portion 30*b* of primary swing arm 30. By this zero-adjustment of the clearance, a dispersion of the lift of first intake valve 3*a* of each cylinder can be reduced while enabling a stabilization of actual lift.

[Third Embodiment]

Figure 14:
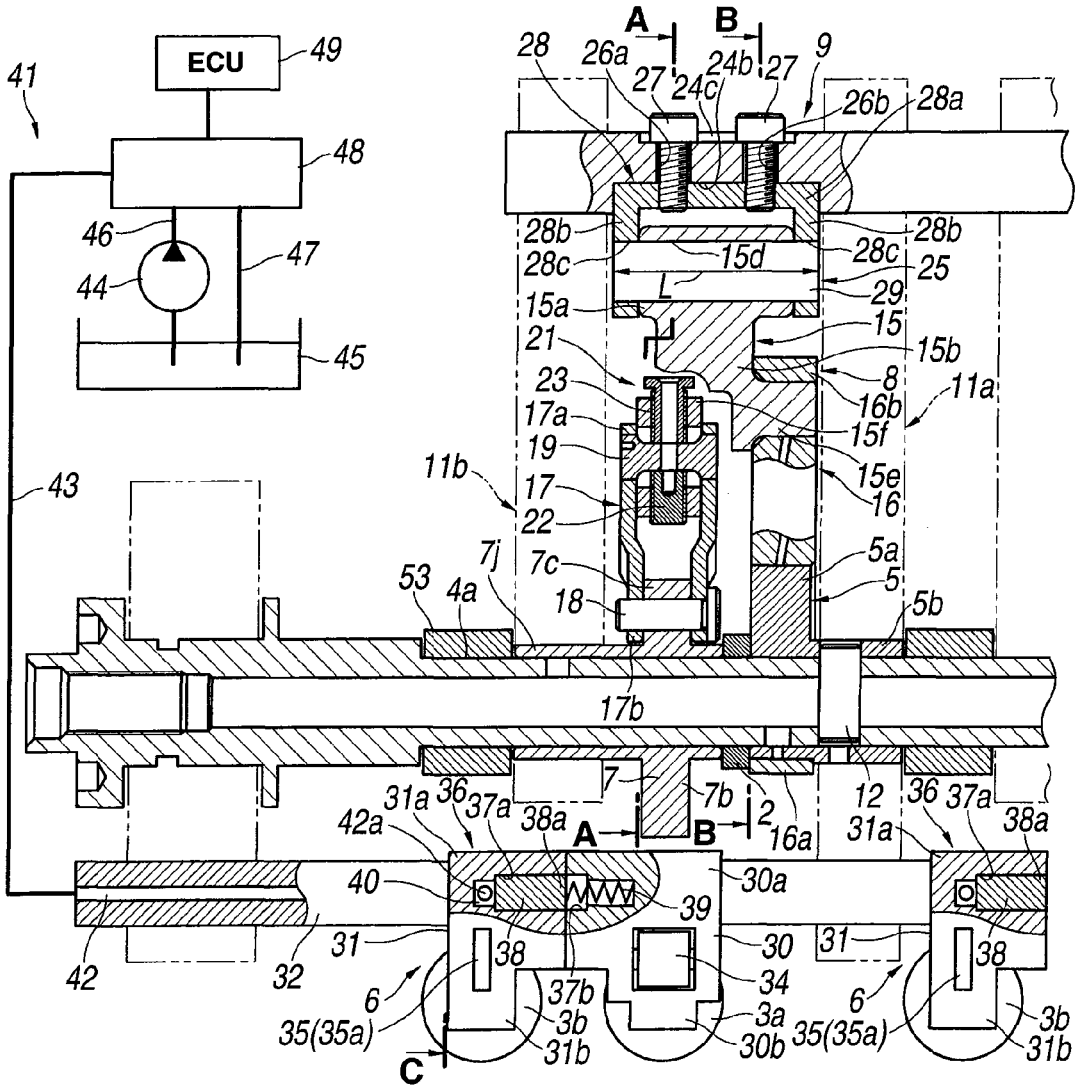
FIG. 14 is a cross sectional view of main parts of a valve control apparatus in a third embodiment according to the present invention.
Figure 15:
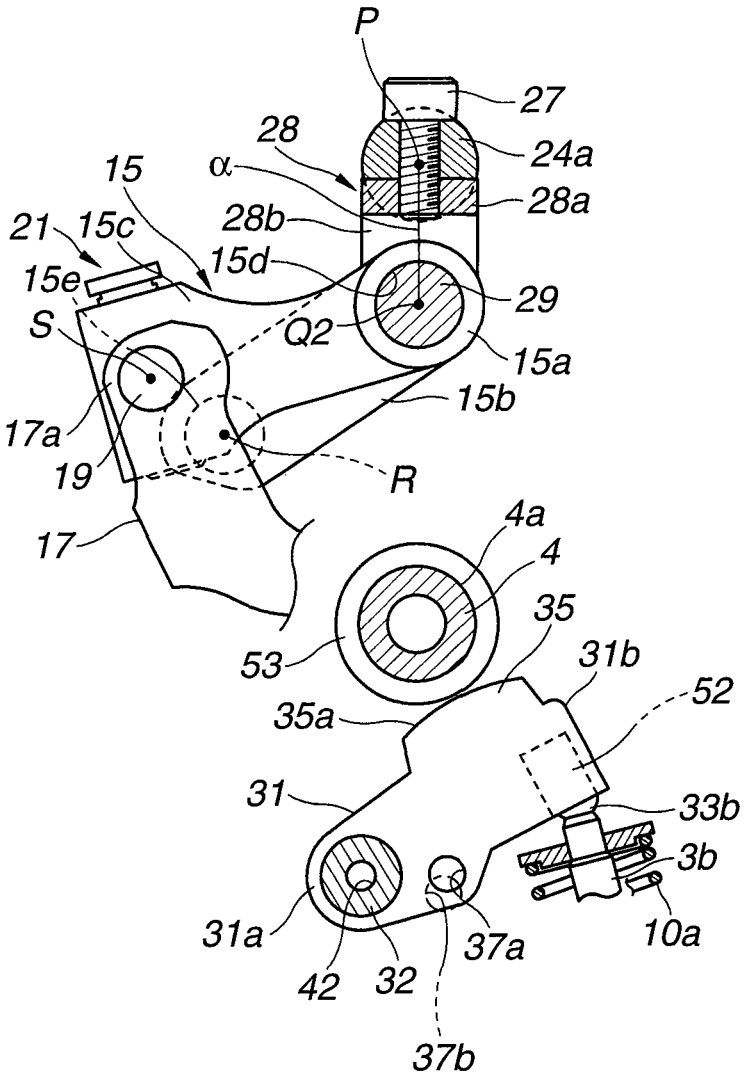
FIG. 15 is a partial cross sectional view showing a side of secondary swing arm in the third embodiment.

FIGS. 14 and 15 show a valve control apparatus in a third embodiment according to the present invention. In the third embodiment, a basic structure of the valve control apparatus is same as the first embodiment. However, another end portion of cam shaft 7*a* of swing cam 7 which is located on the side opposite to the drive cam 5 is formed to extend in the axial direction up to an inner portion of the second bearing portion 11*b*.

Accordingly, this extension portion 7*j* in the another end portion of cam shaft 7*a* is sandwiched between an inner circumferential surface of second bearing portion 11*b* and the outer circumferential surface of drive shaft 4. Hence, the fall of swing cam 7 can be further suppressed during its swinging motion. As a result, the swing motion of swing cam 7 can be more stabilized while stabilizing a lift behavior of the primary swing arm 30 and the like.

Moreover, as shown in FIG. 15, a hydraulic lash adjuster 52 for adjusting a clearance between the stem end of second intake valve 3*b* and the shim 33*b* to become equal to 0 is disposed and held in a receiving groove formed in a lower portion of tip portion 31*b* of secondary swing arm 31.

Thereby, the clearance between the secondary swing arm 31 and the stem end of second intake valve 3*b* can be made equal to 0 even when the secondary swing arm 31 is in the non-lifted state. A dispersion of actual lift among the respective second intake valves 3*b* which is caused due to a dispersion of this clearance among the respective cylinders can be sufficiently suppressed.

Moreover, as shown in FIG. 14, a sleeve roller 53 is rotatably provided on a small-diameter portion 4*a* of the drive shaft 4 and axially outside the second bearing portion 11*b*. The small-diameter portion 4*a* is a portion of drive shaft 4 which has a relatively small diameter. The sleeve roller 53 is formed in a cylindrical tube shape. This sleeve roller 53 is disposed at a location corresponding to the stopper convex portion 35 of secondary swing arm 31, and normally is not in contact with the upper surface 35*a* of stopper convex portion 35 of secondary swing arm 31.

When the primary swing arm 30 is in the non-connected state with the secondary swing arm 31 through the plunger 38, and also when the secondary swing arm 31 is in the non-lifted state; there is a risk that the hydraulic lash adjuster 52 pushes up the secondary swing arm 31 so as to cause the upper surface 35*a* of stopper convex portion 35 to abut on the outer circumferential surface of drive shaft 4 which is rotating at high speed, resulting in an increase of friction.

However, since the sleeve roller 53 is provided in the third embodiment, the sleeve roller 53 does not rotate or rotates at a low speed even if the upper surface 35*a* becomes in contact with an outer circumferential surface of the sleeve roller 53. Therefore, the generation of friction can be suppressed at the upper surface 35*a* of stopper convex portion 35.

According to the third embodiment, a plurality of needles or the like may be provided between an inner circumferential surface of the sleeve roller 53 and an outer circumferential surface of the small-diameter portion 4*a*. In this case, a friction between the drive shaft 4 and the sleeve roller 53 can also be reduced.

Moreover, according to the third embodiment, the extension portion 7*j* of cam shaft 7*a* of swing cam 7 may be formed to further extend in the axial direction so as to be integrated with the sleeve roller 53. Thereby, the number of components can be reduced. In this case, the sleeve roller is configured to swing in synchronization with the swing cam 7. However, an average angular speed of swing cam 7 is sufficiently smaller than that of the drive shaft 4, and hence, the increase of friction at the upper surface 35*a* of stopper convex portion 35 is small.

[Fourth Embodiment]

Figure 16:
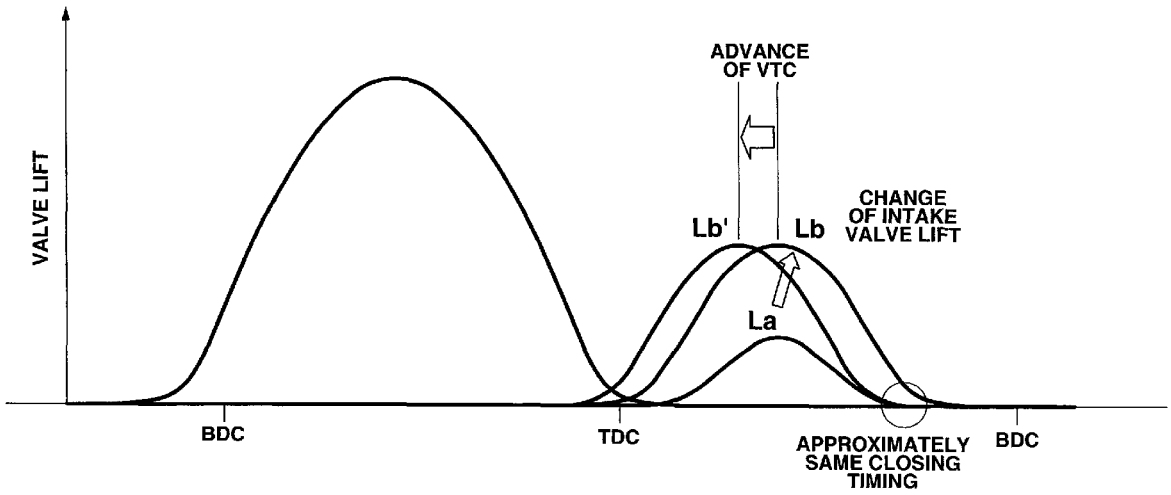
FIG. 16 is a characteristic view showing a lift curve of the first intake valve in a valve control apparatus in a fourth embodiment according to the present invention.

FIG. 16 shows a valve control apparatus in a fourth embodiment according to the present invention. In the fourth embodiment, a valve-timing control unit (VTC) is provided at a front end portion of the drive shaft 4. The valve-timing control unit functions to vary the opening/closing timings of the first and second intake valves 3*a* and 3*b* in accordance with the operating state of engine. That is, the valve-timing control unit (VTC) functions as a phase change mechanism that changes a rotational phase of the drive cam 5 relative to the crankshaft. This valve-timing control unit (VTC) is, for example, of a common vane type.

Accordingly, when the primary swing arm 30 and the secondary swing arm 31 are not connected with each other, the closing timing of first intake valve 3*a* can be varied independently of the control for lift difference between the intake valves 3*a* and 3*b* (lift-amount control of intake valve 3*a*, 3*b*), by the valve-timing control unit (VTC). Therefore, the effect of fuel saving can be more enhanced.

For example, at the time of low-load operation of engine, the magnitude of torque (load) is mostly determined by the closing timing (IVC) of first intake valve 3*a*. In a case that the intake-air swirl effect is insufficient under a current lift curve equal to the characteristic La shown in FIGS. 10 and 16 and therefore it is preferable that the current lift curve is made greater than the characteristic La (i.e., should be brought to a lift curve equal to the characteristic Lb), the closing timing (IVC) is retarded if the current lift curve is simply changed to the characteristic Lb. At this time, there is a risk that the current torque is increased so that the current running state of vehicle deviates from a desired running state of vehicle.

As a countermeasure to this, it is conceivable that the throttle valve is narrowed to reduce the torque. However, by this countermeasure, the pumping loss is increased resulting in a worsening of fuel economy.

Therefore, in this fourth embodiment, the valve-timing control unit (VTC) advances the closing timing (IVC) as shown by a characteristic Lb' of FIG. 16 to reduce a difference between the closing timing (IVC) of characteristic Lb and the closing timing (IVC) of characteristic La, while changing the current lift curve of first intake valve 3*a* from the characteristic La to the characteristic Lb. Thereby, a desired intake-air swirl can be produced while suppressing the above-mentioned torque change (increase).

Moreover, also the increase of pumping loss which is caused in the case of narrowing the throttle valve or in the case of retarding the intake-valve closing timing (IVC) can be suppressed in this embodiment. Therefore, the fuel economy can be more improved.

Incidentally, in the case that the lift difference between the intake valves 3*a* and 3*b* is large, an absolute value of the lift of first intake valve 3*a* is large so that the air flow amount of first intake valve 3*a* is large. Hence, the intake-air swirl effect in whole of the cylinder is large.

On the other hand, in the case that the lift difference between the intake valves 3*a* and 3*b* is small, the absolute value of lift of first intake valve 3*a* is small so that the air flow amount of first intake valve 3*a* is small. However, a flow speed of intake air is high. Thus, a generation form of the intake-air swirl effect is different between the case of large lift amount (characteristic) and the case of small lift amount (characteristic). More favorable one between these two cases is determined according to (judged by) the operating state of engine. It is preferable that the lift amount level is appropriately selected according to the operating state of engine.

In this embodiment, by using the valve-timing control unit (VTC) together, the both of the intake-valve closing timing (IVC) and the lift difference can be selected independently of each other in accordance with the operating state of engine. Hence, an ideal lift difference can be set for every level of the load. Therefore, as mentioned above, both of proper intake-air swirl effect and proper reduction of pumping loss can be satisfied.

Moreover, the second intake valve 3*b* disposed on the side of secondary swing arm 31 continues to be in the non-lifted state, possibly for a ling time. When the operating region of engine for the idling or the low-and-middle partial load within which a high fuel economy is required has continued for a long time, there is a possibility that fuel is collected on an umbrella portion of the second intake valve 3*b* so as to cause a so-called deposit, in a case of employing an engine type in which fuel is injected into the intake port.

However, in the above respective embodiments according to the present invention, the engine in which fuel is injected directly into the cylinder (combustion chamber) is employed. Therefore, the problem that fuel is deposited on the umbrella portion of second intake valve 3*b* is not caused. Also from this point of view, the structure according to the respective embodiments is advantageous.

Although the present invention has been described above with reference to the first and fourth embodiments of the present invention, the present invention is not limited to the embodiments described above. Modifications and variations of the embodiments described above will occur to those skilled in the art in light of the above teachings.

Some technical structures obtainable from the above embodiments according to the present invention will now be listed as follows.

[a] A valve control apparatus for an internal combustion engine, comprising: a variable mechanism (7, 8, 9) configured to vary operating states of two intake valves (3*a*, 3*b*) by varying a swing range of a single swing cam (7), the single swing cam (7) being swingably supported by a shaft (4), the two intake valves (3*a*, 3*b*) being provided to one cylinder; a primary swing arm (30) configured to receive a swinging force from the swing cam (7) by becoming in contact with the swing cam (7), and configured to open and close one of the two intake valves (3*a*, 3*b*) within a contact range between the swing cam (7) and the primary swing arm (30) relative to an axial direction of the shaft (4); a secondary swing arm (31) configured to open and close another of the two intake valves (3*a*, 3*b*) by a swing motion of the secondary swing arm (31); and a connection changeover mechanism (36) configured to connect the primary swing arm (30) with the secondary swing arm (31) or disconnect the primary swing arm (30) from the secondary swing arm (31) in accordance with an operating state of the engine, wherein the connection changeover mechanism (36) is configured to disconnect the primary swing arm (30) from the secondary swing arm (31) to maintain the another of the two intake valves (3*a*, 3*b*) in a non-lifted state, when the variable mechanism (7, 8, 9) controls a swing amount of the primary swing arm (30) within a range below a predetermined amount, and wherein the connection changeover mechanism (36) is configured to connect the primary swing arm (30) with the secondary swing arm (31) to open and close both of the two intake valves (3*a*, 3*b*) together, when the variable mechanism (7, 8, 9) controls the swing amount of the primary swing arm (30) within a range greater than or equal to the predetermined amount.

[b] A valve control apparatus for an internal combustion engine, comprising: a variable mechanism (7, 8, 9) including a drive cam (5) configured to rotate in synchronization with a crankshaft, a single swing cam (7) swingably supported by a support shaft (4), and configured to vary operating states of a pair of intake valves (3*a*, 3*b*) by a variation of swing range of the swing cam (7), a transmission mechanism (8) configured to convert a rotational motion of the drive cam (5) to a swing motion, and to transmit a force of the swing motion to the swing cam (7), and a control mechanism (9) configured to vary an attitude of the transmission mechanism (8) and thereby to vary the swing range of the swing cam (7); a primary swing arm (30) configured to receive a swinging force from the swing cam (7) by becoming in contact with the swing cam (7), and configured to open and close one of the intake valves (3*a*, 3*b*) within a width range of the swing cam (7); a secondary swing arm (31) configured to drive another of the intake valves (3*a*, 3*b*) by a swing motion of the secondary swing arm (31); and a connection changeover mechanism (36) configured to connect the primary swing arm (30) with the secondary swing arm (31) or disconnect the primary swing arm (30) from the secondary swing arm (31) in accordance with an operating state of the engine, wherein lift characteristics of the pair of intake valves (3*a*, 3*b*) become substantially equal to each other when the connection changeover mechanism (36) has connected the primary swing arm (30) with the secondary swing arm (31), wherein the another of the intake valves (3*a*, 3*b*) is maintained in a non-lifted state when the connection changeover mechanism (36) has disconnected the primary swing arm (30) from the secondary swing arm (31).

[c] A valve control apparatus for an internal combustion engine, comprising: a variable mechanism (7, 8, 9) configured to vary operating states of two intake valves (3*a*, 3*b*) by varying a swing range of a single swing cam (7) at least in accordance with an engine load, the two intake valves (3*a*, 3*b*) being provided to one cylinder of the engine; a primary swing arm (30) configured to receive a swinging force from the swing cam (7) by allowing a roller (34) of the primary arm (30) to become in contact with the swing cam (7), and configured to open and close one of the two intake valves (3*a*, 3*b*) within a width range of the roller (34) relative to an axial direction of the roller (34); a secondary swing arm (31) configured to open and close another of the two intake valves (3*a*, 3*b*) by a swing motion of the secondary swing arm (31); and a connection changeover mechanism (36) configured to connect the primary swing arm (30) with the secondary swing arm (31) or disconnect the primary swing arm (30) from the secondary swing arm (31) in accordance with an operating state of the engine, wherein the connection changeover mechanism (36) is configured to disconnect the primary swing arm (30) from the secondary swing arm (31) to maintain the another of the two intake valves (3*a*, 3*b*) in a non-lifted state, when the engine load is lower than a predetermined level, and wherein the connection changeover mechanism (36) is configured to connect the primary swing arm (30) with the secondary swing arm (31) to cause lift characteristics of the two intake valves (3*a*, 3*b*) to become substantially equal to each other, when the engine road is greater than or equal to the predetermined level.

Accordingly, for example, in the low-load region, the another of the two intake valves (3*a*, 3*b*) is maintained in the closed state although the one of the two intake valves (3*a*, 3*b*) is repeatedly opened and closed. Therefore, a sufficient intake-air swirl can be generated in the cylinder, so that the combustion is improved to enhance the fuel saving.

[d] The valve control apparatus as described in the item (b), wherein an axis (Z) of the one of the intake valves (3*a*, 3*b*) is located within the width range of swing cam (7) over which the swing cam (7) abut on the primary swing arm (30), relative to an axial direction of the support shaft (4).

[e] The valve control apparatus as described in the item (b), wherein the valve control apparatus further comprises a bearing portion (11*b*) rotatably supporting the support shaft (4), the bearing portion (11*b*) being located on one side of the swing cam (7) relative to a width direction of the swing cam (7).

[f] The valve control apparatus as described in the item (e), wherein the swing cam (7) includes an extension portion (7*i*) formed in a tubular shape, the extension portion (7*i*) extending into the bearing portion (11*b*) in an axial direction of the support shaft (4).

Accordingly, the extension portion (7*i*) can effectively suppress a fall of the swing cam (7) in the axial direction (left and right directions in FIG. 14), during a swing motion of the swing cam (7).

[g] The valve control apparatus as described in the item (b), wherein the drive cam (5) is provided integrally with a drive shaft (4) receiving a rotational force from the crank shaft.

[h] The valve control apparatus as described in the item (g), wherein the drive shaft (4) constitutes the support shaft (4), and wherein the swing cam (7) includes two pieces (7*e*, 7*f*) which are dividable at a base portion of the swing cam (7) near a swing fulcrum of the swing cam (7), the swing cam (7) being mounted on the drive shaft (4) by connecting the two pieces with each other.

Accordingly, the swing cam (7) can be mounted to the drive shaft (4) after mounting the drive shaft (4) to the engine through the bearing portions (11*a*, 11*b*). Therefore, an assembling process becomes easy.

[i] The valve control apparatus as described in the item (b), wherein the secondary swing arm (31) includes a stopper portion (35) formed on an outer circumferential surface of the secondary swing arm (31), the stopper portion (35) facing the support shaft (4), wherein the stopper portion (35) is normally in noncontact with the support shaft (4), with an attitude of the secondary swing arm (31) where the another of the intake valves (3*a*, 3*b*) is in the non-lifted state, wherein the stopper portion (35) is configured to become in contact with the support shaft (4) to prevent the secondary swing arm (31) from swinging toward the support shaft (4) beyond a predetermined location, when the secondary swing arm (31) further swings toward the support shaft (4) under the state where the another of the intake valves (3*a*, 3*b*) is in the non-lifted state.

[j] The valve control apparatus as described in the item (i), wherein the stopper portion (35) is configured to prevent the secondary swing arm (31) from swinging beyond the predetermined location, by abutting on an outer circumferential surface of the support shaft (4).

[k] The valve control apparatus as described in the item (i), wherein the stopper portion (35) is configured to prevent the secondary swing arm (31) from swinging beyond the predetermined location, by abutting on a sleeve roller (53), and wherein the sleeve roller (53) is provided rotatably on an outer circumferential surface of the support shaft (4).

[l] The valve control apparatus as described in the item (k), wherein a needle is interposed between the sleeve roller (53) and the support shaft (4).

[m] The valve control apparatus as described in the item (b), wherein the control mechanism (9) includes a rotatable control shaft (24), an actuator configured to control a rotation of the control shaft (24), and a control eccentric cam (25) arranged on the control shaft (24), the control eccentric cam (25) including its center deviated from a rotation center of the control shaft (24).

[n] The valve control apparatus as described in the item (m), wherein the transmission mechanism (8) includes a rocker arm (15) swingably provided to the control eccentric cam (25), a link arm (16) linking a swing portion of the rocker arm (15) with the drive cam (5), and a link rod (17) linking the swing portion of the rocker arm (15) with a swing portion of the swing cam (7).

[o] The valve control apparatus as described in the item (b), wherein at least one of the primary swing arm (30) and the secondary swing arm (31) includes a lash adjuster (51, 52) for reducing a clearance between the at least one of the primary swing arm (30) and the secondary swing arm (31) and the corresponding intake valve (3*a*, 3*b*).

[p] The valve control apparatus as described in the item (b), wherein the valve control apparatus further comprises a phase change mechanism configured to change a rotational phase of the drive cam (5) relative to the crank shaft.

[q] The valve control apparatus as described in the item (p), wherein when the control mechanism (9) of the variable mechanism (7, 8, 9) has increased a lift amount of the one of the intake valves (3*a*, 3*b*) by varying the swing range of the swing cam (7) at least under a non-connected state between the primary swing arm (30) and the secondary swing arm (31), the phase change mechanism is configured to change the rotational phase of the drive cam (5) so as to bring a closing timing of the one of the intake valves (3*a*, 3*b*) closer to its timing taken before the increase of lift amount.

Accordingly, when trying to enhance the intake-air swirl effect by largely setting the lift difference between the one of intake valves (3*a*) and the another of intake valves (3*b*) remaining in the non-lifted state, the closing timing varies toward a retardation side if the lift amount of the one of intake valves (3*a*) is simply increased. Thereby, there is a possibility that torque shock is generated. Therefore, the closing timing is controlled to vary toward an advance side so as to conform with an original closing timing taken before the lift increase. Thereby, the generation of torque shock and the like can be suppressed.

[r] The valve control apparatus as described in the item (b), wherein fuel is injected directly into a cylinder of the internal combustion engine.

[s] The valve control apparatus as described in the item (r), wherein an ignition timing of the engine is varied when the connection changeover mechanism (36) connects the primary swing arm (30) with the secondary swing arm (31) or disconnects the primary swing arm (30) from the secondary swing arm (31).

This application is based on prior Japanese Patent Application No. 2009-268199 filed on Nov. 26, 2009. The entire contents of this Japanese Patent Application are hereby incorporated by reference.

The scope of the present invention is defined with reference to the following claims.

What is claimed is:

1. A valve control apparatus for an internal combustion engine, comprising:

a variable mechanism configured to vary operating states of two intake valves by varying a swing range of a single swing cam, the single swing cam being swingably supported by a shaft, the two intake valves being provided on one cylinder;

a primary swing arm configured to: i) receive a swinging force from the single swing cam by coming into contact with the single swing cam, and ii) open and close one of the two intake valves, within a contact range between the single swing cam and the primary swing arm relative to an axial direction of the shaft;

a secondary swing arm configured to open and close another of the two intake valves by a swing motion of the secondary swing arm; and a connection changeover mechanism configured to connect the primary swing arm with the secondary swing arm or disconnect the primary swing arm from the secondary swing arm in accordance with an operating state of the internal combustion engine, wherein the connection changeover mechanism is configured to disconnect the primary swing arm from the secondary swing arm to maintain the another of the two intake valves in a non-lifted state, substantially when the variable mechanism controls a swing amount of the primary swing arm within a range below a predetermined amount, the connection changeover mechanism is configured to connect the primary swing arm with the secondary swing arm to open and close both of the two intake valves together, substantially when the variable mechanism controls the swing amount of the primary swing arm within a range greater than or equal to the predetermined amount, and the secondary swing arm includes a stopper portion formed on an outer circumferential surface of the secondary swing arm, the stopper portion: i) facing the shaft, ii) being in noncontact with the shaft, while the secondary swing arm is in a position where the another of the two intake valves is in the non-lifted state, and iii) being configured to come into contact with the shaft to prevent the secondary swing arm from swinging toward the shaft beyond a predetermined location, substantially when the secondary swing arm further swings toward the shaft as the another of the two intake valves is in the non-lifted state.

2. A valve control apparatus for an internal combustion engine, comprising:

a variable mechanism including a drive cam configured to rotate in synchronization with a crankshaft, a single swing cam swingably supported by a support shaft, the single swing cam being configured to vary operating states of a pair of intake valves via a variation of swing range of the single swing cam, a transmission mechanism configured to: i) convert a rotational motion of the drive cam to a swing motion, and ii) transmit a force of the swing motion to the single swing cam, and a control mechanism configured to vary a position of the transmission mechanism to thereby vary the swing range of the single swing cam;

a primary swing arm configured to: i) receive a swinging force from the single swing cam by coming into contact with the single swing cam, and ii) open and close one of the pair of intake valves within a width range of the single swing cam;

a secondary swing arm configured to drive another of the pair of intake valves by a swing motion of the secondary swing arm; and a connection changeover mechanism configured to connect the primary swing arm with the secondary swing arm or disconnect the primary swing arm from the secondary swing arm in accordance with an operating state of the internal combustion engine, wherein lift characteristics of the pair of intake valves become substantially equal to each other substantially when the connection changeover mechanism has connected the primary swing arm with the secondary swing arm, the another of the pair of intake valves is maintained in a non-lifted state substantially when the connection changeover mechanism has disconnected the primary swing arm from the secondary swing arm, and the secondary swing arm includes a stopper portion formed on an outer circumferential surface of the secondary swing arm, the stopper portion: i) facing the support shaft, ii) being in noncontact with the support shaft, while the secondary swing arm is in a position where the another of the pair of intake valves is in the non-lifted state, and iii) being configured to come into contact with the support shaft to prevent the secondary swing arm from swinging toward the support shaft beyond a predetermined location, substantially when the secondary swing arm further swings toward the support shaft as the another of the pair of intake valves is in the non-lifted state.

3. The valve control apparatus as claimed in claim 2, wherein an axis of the one of the pair of intake valves is located within the width range of the single swing cam over which the single swing cam abuts on the primary swing arm, relative to an axial direction of the support shaft.

4. The valve control apparatus as claimed in claim 2, wherein the valve control apparatus further comprises a bearing portion rotatably supporting the support shaft, the bearing portion being located on one side of the single swing cam relative to a width direction of the single swing cam.

5. The valve control apparatus as claimed in claim 4, wherein the single swing cam includes an extension portion formed in a tubular shape, the extension portion extending into the bearing portion in an axial direction of the support shaft.

6. The valve control apparatus as claimed in claim 2, wherein the drive cam is provided integrally with a drive shaft receiving a rotational force from the crankshaft.

7. The valve control apparatus as claimed in claim 6, wherein the drive shaft constitutes the support shaft, and the single swing cam includes two pieces which are dividable at a base portion of the single swing cam near a swing fulcrum of the single swing cam, the single swing cam being mounted on the drive shaft by connecting the two pieces with each other.

8. The valve control apparatus as claimed in claim 2, wherein the stopper portion is configured to prevent the secondary swing arm from swinging beyond the predetermined location, by abutting on an outer circumferential surface of the support shaft.

9. The valve control apparatus as claimed in claim 2, wherein the stopper portion is configured to prevent the secondary swing arm from swinging beyond the predetermined location, by abutting on a sleeve roller, and the sleeve roller is provided rotatably on an outer circumferential surface of the support shaft.

10. The valve control apparatus as claimed in claim 9, wherein a needle is interposed between the sleeve roller and the support shaft.

11. The valve control apparatus as claimed in claim 2, wherein the control mechanism includes a rotatable control shaft, an actuator configured to control a rotation of the control shaft, and a control eccentric cam arranged on the control shaft, the control eccentric cam including its center deviated from a rotation center of the control shaft.

12. The valve control apparatus as claimed in claim 11, wherein the transmission mechanism includes a rocker arm swingably provided to the control eccentric cam, a link arm linking a swing portion of the rocker arm with the drive cam, and a link rod linking the swing portion of the rocker arm with a swing portion of the single swing cam.

13. The valve control apparatus as claimed in claim 2, wherein at least one of the primary swing arm and the secondary swing arm includes a lash adjuster for reducing a clearance between the at least one of the primary swing arm and the secondary swing arm and the corresponding intake valve.

14. The valve control apparatus as claimed in claim 2, wherein the valve control apparatus further comprises:

a phase change mechanism configured to change a rotational phase of the drive cam relative to the crankshaft.

15. The valve control apparatus as claimed in claim 14, wherein when the control mechanism of the variable mechanism has increased a lift amount of the one of the pair of intake valves by varying the swing range of the single swing cam at least under a non-connected state between the primary swing arm and the secondary swing arm, the phase change mechanism is configured to change the rotational phase of the drive cam so as to bring a closing timing of the one of the pair of intake valves closer to its timing taken before the increase of the lift amount.

16. The valve control apparatus as claimed in claim 2, wherein fuel is injected directly into a cylinder of the internal combustion engine.

17. The valve control apparatus as claimed in claim 16, wherein an ignition timing of the internal combustion engine is varied when the connection changeover mechanism connects the primary swing arm with the secondary swing arm or disconnects the primary swing arm from the secondary swing arm.

18. A valve control apparatus for an internal combustion engine, comprising:

a variable mechanism configured to vary operating states of two intake valves by varying a swing range of a single swing cam at least in accordance with an engine load, the two intake valves being provided on one cylinder of the engine;

a primary swing arm configured to: i) receive a swinging force from the single swing cam by allowing a roller of the primary swing arm to come into contact with the single swing cam, and ii) open and close one of the two intake valves, within a width range of the roller relative to an axial direction of the roller;

a secondary swing arm configured to open and close another of the two intake valves via a swing motion of the secondary swing arm; and a connection changeover mechanism configured to connect the primary swing arm with the secondary swing arm or disconnect the primary swing arm from the secondary swing arm in accordance with an operating state of the internal combustion engine, wherein the connection changeover mechanism is configured to disconnect the primary swing arm from the secondary swing arm to maintain the another of the two intake valves in a non-lifted state, substantially when the engine load is lower than a predetermined level, the connection changeover mechanism is configured to connect the primary swing arm with the secondary swing arm to cause lift characteristics of the two intake valves to become substantially equal to each other, substantially when the engine load is greater than or equal to the predetermined level, and the secondary swing arm includes a stopper portion formed on an outer circumferential surface of the secondary swing arm, the stopper portion: i) facing a support shaft that swingably supports the single swing cam, ii) being in noncontact with the support shaft, while the secondary swing arm is in a position where the another of the two intake valves is in the non-lifted state, and iii) being configured to come into contact with the support shaft to prevent the secondary swing arm from swinging toward the support shaft beyond a predetermined location, substantially when the secondary swing arm further swings toward the support shaft as the another of the two intake valves is in the non-lifted state.

* * * * *